US011641999B2

(12) United States Patent
Lee et al.

(10) Patent No.: US 11,641,999 B2
(45) Date of Patent: May 9, 2023

(54) CLEANER

(71) Applicant: LG ELECTRONICS INC., Seoul (KR)

(72) Inventors: Minwoo Lee, Seoul (KR); Jaewon Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 233 days.

(21) Appl. No.: 16/943,229

(22) Filed: Jul. 30, 2020

(65) Prior Publication Data

US 2021/0030243 A1 Feb. 4, 2021

(30) Foreign Application Priority Data

Jul. 31, 2019 (KR) ..... 10-2019-0093479
Dec. 27, 2019 (KR) ..... 10-2019-0176622

(51) Int. Cl.
*A47L 11/40* (2006.01)
*A47L 11/24* (2006.01)
*A47L 11/283* (2006.01)

(52) U.S. Cl.
CPC ..... *A47L 11/4013* (2013.01); *A47L 11/24* (2013.01); *A47L 11/283* (2013.01); *A47L 11/4038* (2013.01); *A47L 11/4061* (2013.01); *A47L 11/4066* (2013.01); *A47L 11/4069* (2013.01); *A47L 2201/04* (2013.01); *A47L 2201/06* (2013.01)

(58) Field of Classification Search
CPC ..... A47L 11/145; A47L 11/185; A47L 11/24; A47L 11/283; A47L 11/292; A47L 11/293; A47L 11/4013; A47L 11/4038; A47L 11/4041; A47L 11/4066; A47L 11/4069; A47L 2201/00
See application file for complete search history.

(56) References Cited

U.S. PATENT DOCUMENTS 2,783,487 A * 3/1957 Luders ..... A47L 11/4025 15/41.1
4,498,207 A * 2/1985 Rosendall ..... A47L 11/33 15/42
5,208,935 A * 5/1993 Jailor ..... A47L 11/4075 15/41.1

(Continued)

FOREIGN PATENT DOCUMENTS

CN 1454566 A 11/2003
CN 1630484 A 6/2005
CN 102648835 A 8/2012

(Continued)

*Primary Examiner* — Randall E Chin
(74) *Attorney, Agent, or Firm* — Birch, Stewart, Kolasch & Birch, LLP

(57) ABSTRACT

A mobile cleaner includes a dust housing, an agitator, and a dustpan. The dust housing has a collection opening facing a surface. The agitator is rotatably disposed within the dust housing and is exposed to the surface through the collection opening. The agitator is configured to move foreign material from the floor into the dust housing. The dustpan directs the foreign material moved by the agitator into the dust housing. The dustpan extends around a portion of an outer circumferential surface of the agitator and is configured to rotate independent of the agitator.

19 Claims, 20 Drawing Sheets

(56) References Cited

U.S. PATENT DOCUMENTS

2010/0269290 A1 10/2010 Lee

FOREIGN PATENT DOCUMENTS

| | | | |
|---|---|---|---|
| CN | 105246387 | A | 1/2016 |
| JP | 2003-320322 | A | 11/2003 |
| JP | 3803291 | B2 | 8/2006 |
| JP | 2012-5574 | A | 1/2012 |
| KR | 20-2011-0006014 | U | 6/2011 |
| KR | 10-1556965 | B1 | 10/2015 |
| KR | 10-2019-0015935 | A | 2/2019 |

* cited by examiner

CLEANER

BACKGROUND

1. Field

The present disclosure relates to a cleaner, and more particularly, to a cleaner capable of easily sweeping a foreign material on a floor.

2. Description

A cleaner is a device that cleans a floor by inhaling a foreign material such as a dust on the floor or wiping a foreign material on the floor. Recently, a cleaner capable of mopping a floor has been developed. In addition, a robot cleaner is a device that cleans while driving or traveling on its own.

In Korean Patent Publication No. 10-1602790 (hereinafter, referred to as KR'790), a robot cleaner capable of traveling while performing wet-type cleaning using a wet-type cleaner is disclosed.

In KR'790, the robot cleaner includes a pair of cleaners arranged in a left-right direction, and a driving unit that rotates each cleaner by providing driving force. In KR'790, both of wet-type cleaning and traveling are performed through the pair of cleaners, but inhaling of a foreign material on a floor is impossible.

In Korean Patent Laid-Open Publication No. 10-2005-0034112 (hereinafter, referred to as KR'112), a robot cleaner equipped with a dust container and a mop. In KR'112, since a wheel and a motor for traveling or driving of the robot cleaner and a suction fan and a motor for inhaling a dust should be separately provided, an operation structure may be complex.

Particularly, in KR'112, since a dust is inhaled through a pressure difference by a suction fan, power consumption may be large and a large noise may be generated.

Further, in the conventional art, since a robot cleaner proceeds only by friction force of spin mops and a water level of stored water in a water tank is variable, it may be difficult to effectively mop a floor and driving power may be not sufficient.

Particularly, it may be very difficult for the conventional wet-type robot to adjust a traveling direction by friction force with rotating mops. Accordingly, cleaning is performed only by a random driving, and cleaning by a pattern driving being able to meticulously clean is impossible.

Further, in the conventional art, since the cleaning is possible only by the random driving, meticulous cleaning at a corner of a floor or an area adjacent to a wall may be difficult.

SUMMARY

In a cleaner traveling or moving by friction force of a spin mop, if there is a suction fan for sucking a dust, power consumption may be large and a volume of the cleaner may be large. If the suction fan is omitted or removed from the cleaner using the spin mop, an ability to inhale a dust may be reduced and thus a large dust or foreign material on a floor may remain after cleaning. Accordingly, the present disclosure is for providing a cleaner being able to solve the problem and to collect a foreign material only by rotational force of an agitator through including a dustpan that guides the foreign material when the agitator rotates.

The present disclosure is also for providing a cleaner being able to easily sweep up a foreign material on a floor through rotation of an agitator disposed at a front side of a mop module.

The present disclosure is for providing a cleaner equipped with a dustpan being able to effectively sweep up a foreign material on a floor and avoiding contact with an obstacle on a floor.

The present disclosure is for providing a cleaner being able to effectively sweep up a foreign material on a floor in a structure where an agitator and a dust housing are integrated with each other.

The present disclosure is for providing a cleaner being able to clean a foreign material on a floor at a front side of a pair of mop modules before the foreign material is in contact with the mop module in a cleaner that travels and mop the floor by rotation of the pair of mop modules.

The present disclosure is for providing a cleaner having a structure where an agitator and a dust housing are integrated with each other.

When a body of a cleaner has a circular shape or a shape close to a circular shape, rotation in place is easy. When the rotation in place is easy, a cleaner can easily escape from an obstacle area or a corner. However, when the body of the cleaner has the circular shape, a width of an agitator is limited to be smaller than a diameter of the body so that the agitator is not disturbed by an obstacle during the body rotates. Accordingly, the present disclosure is for providing a cleaner being able to maximize a width of an agitator in a state that the agitator does not protrude from the body by disposing a storage space that stores a foreign material collected from the agitator at a front side than the agitator. Therefore, a size of an area to be cleaned at once is not reduced. In this instance, the cleaner according to the present disclosure makes rotation of the body easy by limiting the width of the agitator to be smaller than a diameter of the body.

The present disclosure is for providing a cleaner being able to make rotation of a body easy by a circular shape of the body. In this instance, the cleaner according to the present disclosure can reduce friction between an obstacle and spin mops, make rotation of the body easy, and maximize a size of an area to be cleaned at once when the body rotates by disposing rotation axes of a pair of spin mops to be eccentrical or deviated from a center of the body and disposing a part of each spin mop to be overlapped with the body vertically.

The present disclosure is also for providing a robot cleaner or a mobile robot being able to increase friction force between a mop and a floor regardless of a water-level change in a water tank for effective mopping and traveling and to perform a pattern driving that allows meticulous cleaning through accurate driving.

A robot cleaner or a mobile robot according to the present disclosure includes an agitator rotating and collecting a foreign material on a floor and a dustpan for guiding the foreign material moved by the agitator into an inside of a dust housing. The dustpan covers a part of an outer circumferential surface of the agitator and independently rotates with the agitator. Accordingly, insufficient cleaning power of the agitator can be compensated and the dustpan can be prevented from being damaged.

When the dustpan of the present disclosure interferes with an obstacle on the floor, the dustpan is rotated and accommodated into a collection space positioned at the inside of a dust housing.

More particularly, a cleaner according to the present disclosure includes a dust housing, an agitator, and a dustpan. The dust housing has a collection opening surface toward a floor. The agitator is disposed at an inside of the dust housing, is rotatably assembled with the dust housing, and is exposed to an outside through the collection opening surface. The agitator is in contact with the floor to sweep up a foreign material on the floor into the inside of the dust housing. The dustpan is installed on any one of the dust housing and the agitator and guides the foreign material moved by the agitator into the inside of the dust housing. The dustpan surrounds a part of an outer circumferential surface of the agitator and is installed to independently rotate with the agitator.

The dustpan is rotatable with respect to a rotation axis. Accordingly, when the dustpan interferes with an obstacle on the floor, the dustpan can be rotated and accommodated into a collection space positioned at the inside of the dust housing.

The agitator may rotate from a front side to a rear side and the dustpan may be disposed at a rear side of the agitator. The foreign material moved to the rear side is guided to the collection space by the dustpan.

The dustpan may be installed on the dust housing. The dustpan may cover a part of the outer circumferential surface and parts of both side surfaces of the agitator, thereby minimizing a breakaway of the foreign material to an outside the dustpan.

A rotation axis of the dustpan may be positioned at a rotation axis of the agitator.

The dust housing may include a housing assembly, the collection opening surface, a partition, and a storage opening surface. The housing assembly may have a collection space and a storage space at an inside of the housing assembly. The collection opening surface may be disposed at a bottom surface of the housing assembly, communicate with a lower side of the collection space, and be exposed toward the floor. The partition may be disposed at the inside of the housing assembly and partition the collection space and the storage space. The storage opening surface may be disposed at one of the housing assembly or the partition and guide the foreign material in the collection space to the storage space. The agitator and the dustpan may be disposed at the collection space.

The rotation axis of the agitator may extend in a left-right direction. The dustpan may be disposed at an opposite side of the partition with respect to the rotation axis of the agitator.

The cleaner may further include a pan elastic member having one end fixed to the dustpan and the other end fixed to the housing assembly. The dustpan may be further provided with a first pan fixing portion where the one end of the pan elastic member is fixed. The housing assembly may be further provided with a second pan fixing portion where the other end of the pan elastic member is fixed.

The first pan fixing portion may be disposed higher than the second pan fixing portion.

The rotation axis of the agitator may extend in a left-right direction. The first pan fixing portion and the second pan fixing portion may be disposed at an opposite side of the partition with respect to the rotation axis of the agitator.

The cleaner according to the present disclosure may further include a dustpan stopper disposed at the housing assembly. The dustpan stopper may form a mutual interference structure with the dustpan to limit rotation of the dustpan. The dustpan stopper may be disposed within a rotation radius of the dustpan.

The dustpan stopper may be disposed at a lower side of the dustpan.

The dustpan may further include a guide pan housing formed to surround a part of the outer circumferential surface of the agitator, and a side pan housing disposed at one side of the guide pan housing and surrounding a side portion of the agitator.

The guide pan housing may include a curved portion surrounding the outer circumferential surface of the agitator, and a dust guard coupled to a lower end of the curved portion and in contact with the floor. The dust guard may protrude to a lower side of the collection opening surface and may be formed of an elastic material.

A curvature center of the curved portion may be disposed at an inside of the agitator.

The cleaner according to the present disclosure may further include a through hole penetrating the side pan housing and a pan guide inserted into the through hole at the side surface of the housing assembly. A side portion of the agitator may be rotatably supported by the housing assembly through penetrating the through hole. The side pan housing may be rotated through being supported by the pan guide.

In addition, a cleaner according to the present disclosure includes a body, and a sweep module installed on a lower portion of the body to collect a foreign material.

The sweep module includes an agitator rotating and collecting the foreign material on a floor, a storage space where the foreign material collected by the agitator is stored, and a dustpan for guiding the foreign material moved by the agitator into an inside of a dust housing. The dustpan covers a part of an outer circumferential surface of the agitator and independently rotates with the agitator. A rotation axis of the dustpan may be positioned at a rotation axis of the agitator.

The dustpan may be disposed at an area of 40% to 70% of an arbitrary circle surrounding an outer circumference of the agitator.

The dustpan may move within an arc having a center angle of 180 degrees to 220 degrees at an orbit of the arbitrary circle surrounding the outer circumference of the agitator. The dustpan may have a smaller length than the arc.

Further, a cleaner according to the present disclosure includes a body having a circular shape when view from an upper side, and a sweep module installed on a lower portion of the body to collect a foreign material and completely overlapped with the body vertically. The sweep module includes an agitator rotating and collecting the foreign material on a floor and a storage space where the foreign material collected by the agitator is stored. The storage space may be disposed at a front side than the agitator.

Also, the cleaner according to the present disclosure may further include a spin mop that is rotated. A mop portion may be attached to a lower surface of the spin mop.

Firstly, according to the present disclosure, interference or impact with or from an obstacle can be minimized since a dustpan is rotated and is accommodated into a collection space positioned at inside of a dust housing when the dustpan is interfered with the obstacle on a floor.

Secondly, according to the present disclosure, a collected foreign material can be transferred to a collection space, even if a dustpan collides with an obstacle on a floor, since the dustpan is rotatable with respect to a rotation axis of the agitator.

Thirdly, according to the present disclosure, a collected foreign material can be transferred to a collection space in a state confined between a dustpan and an agitator since the dustpan is in contact with an outer circumferential surface of the agitator.

Fourthly, according to the present disclosure, a dustpan can be returned to its original position by using an elastic force of a pan elastic member since the pan elastic member connects the dustpan and a housing assembly, Fifthly, according to the present disclosure, an impact due to a contact with an obstacle can be minimized since a dust guard, which is disposed at a lower end of the dustpan and is in contact with a floor, is formed of an elastic material.

Sixthly, according to the present disclosure, excessive rotation of a dustpan can be prevented by a dustpan stopper disposed at a housing assembly and disposed within a rotational radius of the dustpan.

Seventhly, according to the present disclosure, resistance against a driving or traveling direction of a cleaner can be minimized and a dustpan disposed at a rear side of an agitator can effectively collect a foreign material moved through sweeping of the agitator since the agitator rotates from a front side to a rear side.

Eighthly, according to the present disclosure, by disposing an agitator close to a center of a body in a structure in which the agitator and a dust housing are integrated with each other, the agitator is not disturbed by an external obstacle and a width of the agitator in a left-right direction can be maximized. Thereby, a cleaning area can be maximized, a body can escape quickly when trapped in the obstacle, and the body can rotate easily.

Ninthly, according to the present disclosure, rotation of a cleaner can be easy by a circular shape of a body. A size of an area to be cleaned by a spin mop at once can be maximized and rotation of a body is not disturbed by a shape of the spin mop when the body rotates, since rotation axes of a pair of spin mops are eccentrical or deviated from a center of the body and a part of each spin mop is overlapped with the body vertically. That is, a part of each spin mop is exposed to an outside of the body. Even if the spin mop is exposed to the outside of the body, the spin mop has a circular shape, and thus, friction between an obstacle and the spin mop is reduced when the body rotates. Accordingly, the rotation of the body can be easy.

Tenthly, according to the present disclosure, a body has a circular shape and a dry-type module does not protrude to an outside of the body. Accordingly, the cleaner can be freely rotated at any position in a cleaning area. Also, an agitator can have a sufficiently large width, and thus, a cleaning range can be wide. Further, a mopping operation while collecting a foreign material having a relatively large size can be performed.

DETAILED DESCRIPTION

Expressions referring to directions such as a front direction (a frontward direction or a forward direction) (F), a rear direction (a rearward direction) (R), a left direction (a leftward direction) (Le), a right direction (a rightward direction) (Ri), an upper direction (an up direction or an upward direction) (U), and a down direction (an downward direction) (D), or so on may be defined base on a driving direction of a cleaner (a vacuum cleaner). This is just for explaining the present disclosure with reference to the accompanying drawings to be clearly understood. Therefore, directions may be defined differently depending on where a reference is placed.

For example, a direction parallel to an imaginary line connecting a central axis of a left spin mop and a central axis of a right spin mop may be defined as a left-right direction. A direction perpendicular to the left-right direction and parallel to the central axes of the spin mops or has an error angle within 5 degrees with the central axes of the spin mops may be defined as an up-down direction or a vertical direction. A direction perpendicular to each of the left-right direction and the up-down direction may be defined as a front-back direction or a longitudinal direction. A front direction may mean a main traveling direction of a mobile robot or a main traveling direction of a pattern traveling of a mobile robot. In this instance, the main traveling direction may mean a vector sum value of directions traveling in a predetermined time.

A term of 'first', 'second', 'third', or so on in front of a component mentioned below is only to avoid confusion between the component being referred to and other component, and does not relate to an order, an importance, or a master-servant relationship between components. For example, an embodiment only having a second component without a first component may be possible.

A term of 'a mop' mentioned hereinafter may have any of materials such as fabric or paper, and may be a multi-use product being able to be used repeatedly through washing or a disposable product.

The present disclosure may be applied to a cleaner (for example, a vacuum cleaner) manually moved by a user or a robot cleaner traveling or driving on its own. Hereinafter, an embodiment will be described based on a robot cleaner.

Figure 1:
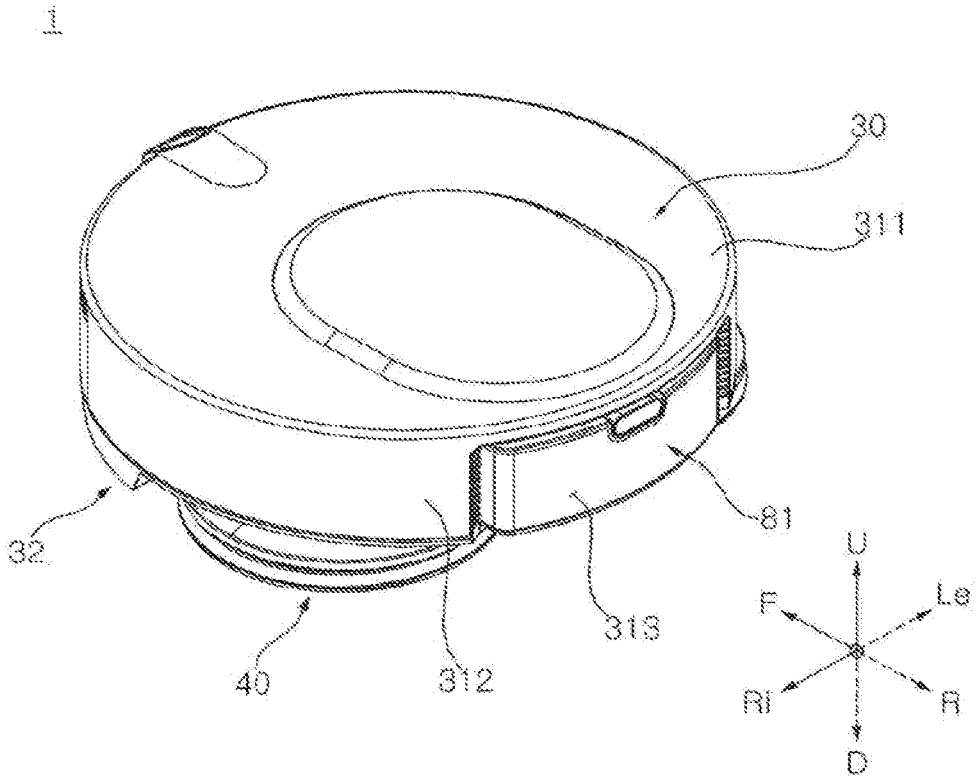
FIG. 1 is a perspective view of a cleaner according to a first embodiment of the present disclosure.
Figure 2:
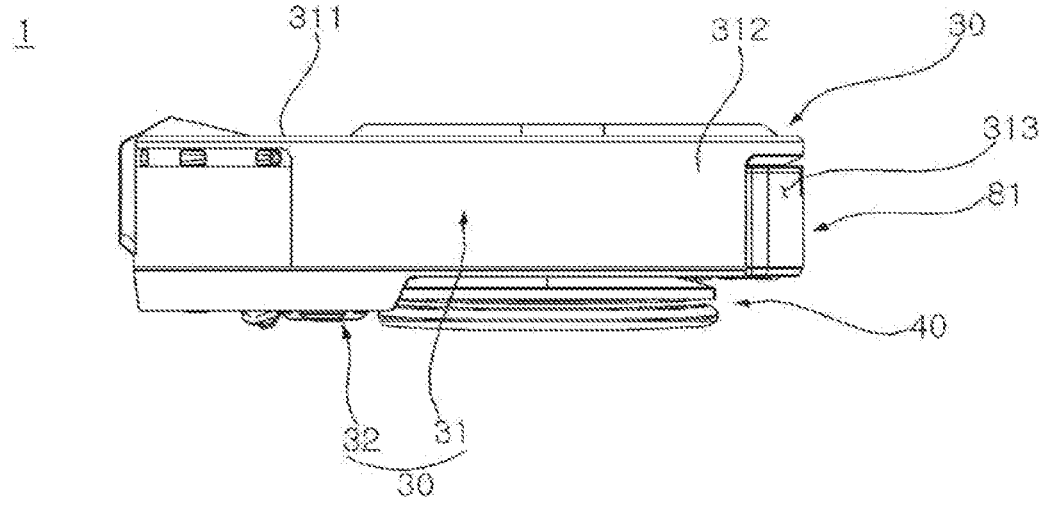
FIG. 2 is a left side view of the cleaner shown in FIG. 1.
Figure 3:
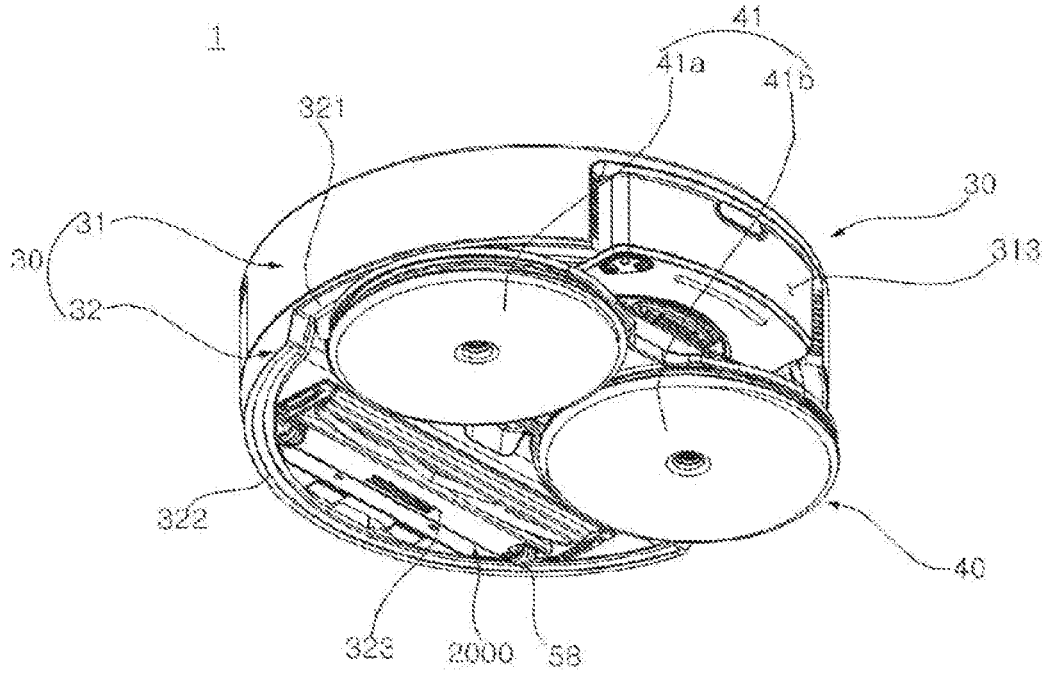
FIG. 3 is a bottom perspective view of the cleaner shown in FIG. 1.
Figure 4:
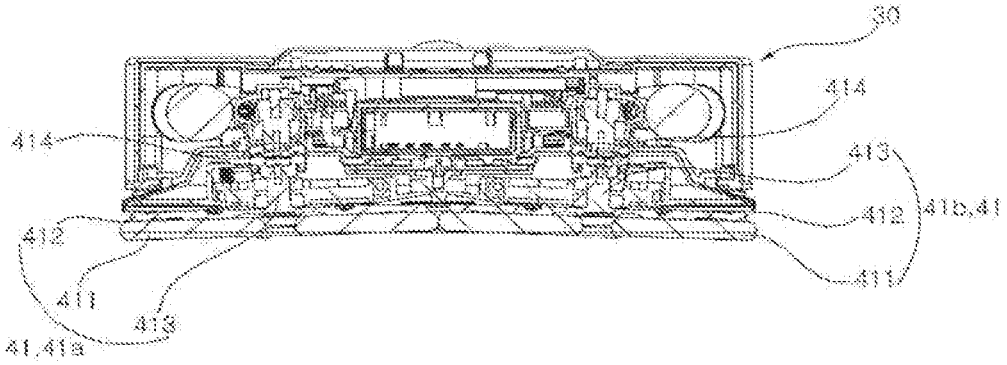
FIG. 4 is a front cross-sectional view of the cleaner shown in FIG. 1.

FIG. 1 is a perspective view of a cleaner according to a first embodiment of the present disclosure. FIG. 2 is a left side view of the cleaner shown in FIG. 1. FIG. 3 is a bottom perspective view of the cleaner shown in FIG. 1. FIG. 4 is a front cross-sectional view of the cleaner shown in FIG. 1.

Referring to FIG. 1 to FIG. 4, a cleaner 1 according to an embodiment of the present disclosure may include a body 30 having a controller. The cleaner 1 may include a mop module 40 to mop a floor (a surface to be cleaned) while being in contact with the floor. The cleaner 1 may include a sweep module 2000 provided to collect a foreign material on the floor.

The mop module 40 may be disposed at a lower side of the body 30 and may support the body 30. The sweep module 2000 may be disposed at the lower side of the body 30 and may support the body 30. In the present embodiment, the body 30 may be supported by the mop module 40 and the sweep module 2000. The body 30 may form an appearance or an exterior. The body 30 may be arranged to connect the mop module 40 and the sweep module 2000.

The mop module 40 may form an appearance or an exterior. The mop module 40 is disposed at the lower side of the body 30. The mop module 40 is disposed at a rear side of the sweep module 2000. The mop module 40 provides driving force for a movement of the cleaner 1. In order to move the cleaner 1, the mop module 40 may be preferably disposed at the rear side of the cleaner 1.

The mop module 40 may be provided with at least one mop portion 411 to mop the floor while rotating. The mop module 40 may include at least one spin mop 41, and the spin mop 41 may rotate in a clockwise direction or a counterclockwise direction when viewed from an upper side. The spin mop 41 may be in contact with the floor.

In the present embodiment, the mop module 40 may include a pair of spin mops 41*a* and 41*b*. The pair of spin mops 41*a* and 41*b* may rotate in a clockwise direction or a counterclockwise direction when viewed from an upper side, and may mop the floor through rotation. When the pair of spin mops 41*a* and 41*b* are viewed from a traveling direction of the cleaner, a spin mop disposed at a left side may be referred to as a left spin mop 41*a*, and a spin mop disposed at a right side may be defined as a right spin mop 41*b*.

Each of the left spin mop 41*a* and the right spin mop 41*b* may be rotated with respect to its rotation axis. The rotation axis may be arranged in an up-down direction. The left spin mop 41*a* and the right spin mop 41*b* may be rotated independently of each other.

Each of the left spin mop 41*a* and the right spin mop 41*b* may include a mop portion 411, a rotating plate 412, and a spin shaft 414. Each of the left spin mop 41*a* and the right spin mop 41*b* may include a water container (a water receiving portion) 413.

The left spin mop 41*a* and the right spin mop 41*b* may be rotatably installed on a lower portion of the body 30, be in contact with a floor, and move the body 30.

Rotation axes osa and osb (see FIG. 31) of the pair of spin mops may cross a lower surface of the body and be vertically overlapped with the body. The rotation axes osa and osb of the pair of spin mops may be eccentrical or deviated from a center of the body, and a part of the left spin mop 41*a* and a part of the right spin mop 41*b* may be vertically overlapped with the body 30.

Therefore, according to the present disclosure, rotation of the body is not hindered or disturbed by a shape of the spin mop when the body rotates. That is, when a part of each spin mop is exposed to an outside of the body, the spin mop has a circular shape, and thus, friction between an obstacle and the spin mop is reduced when the body rotates. Accordingly, the rotation of the body can be easy.

That is, if entire portions of the left spin mop 41*a* and right spin mop 41*b* overlap vertically with the body 30, rotational motion of the body 30 is easy, but an area to be cleaned at once is too small. Thus, according to the present disclosure, the left spin mop 41*a* and the right spin mop 41*b* may be exposed at the outside of the body 30 to a degree that it does not disturb the rotation of the body 30, and an area to be cleaned by the left spin mop 41*a* and the right spin mop 41*b* can be maximized.

A ratio of an area where the left spin mop 41*a* or the right spin mop 41*b* is vertically overlapped with the body may be preferably 85% to 95% of each spin mop. Considering a relationship with a sweep module, a position where each spin mop is exposed may be preferably positioned between a lateral side and a rear side of the body 30. A distance between a center of the body 30 and the rotation axis osa of the left spin mop 41*a* may be the same as a distance between the center of the body 30 and the rotation axis osb of the right spin mop 41*b*.

The sweep module 2000 may form an appearance or an exterior. The sweep module 2000 may be disposed at a front side of the mop module 40. In order to prevent a foreign material on the floor from first contacting the mop module 40, the sweep module 2000 may preferably disposed at the front side of the cleaner 1 in a traveling direction.

The sweep module 2000 may be spaced apart from the mop module 40. The sweep module 2000 may disposed at the front side of the mop module 40 and be in contact with the floor. The sweep module 2000 may be installed on a lower portion of the body 30.

The sweep module 2000 may be completely overlapped with the body 30 vertically. In this instance, the phrase of "the sweep module 2000 is completely overlapped with body 30 vertically" may mean that an entire portion of the sweep module 2000 is vertically overlapped with the body 30 and the sweep module 2000 is not exposed to an outside of the body 30 when viewed from an upper side.

The sweep module 2000 may be in contact with the floor and may collect the foreign material at the front side of the sweep module 2000 to an inside when the cleaner 1 moves. The sweep module 2000 may be disposed at a lower side of the body 30. A width of the sweep module 2000 in a left-right direction may be smaller than a width of the mop module 40 in the left-right direction.

The body 30 may include a case 31 forming an appearance or an exterior and a base 32 disposed at a lower side of the case 31. An outer surface of the body 30 may form at least a part of a circle having a radius having an error with a reference radius within a reference error range. Specifically, when viewed from a vertical direction, 50% or more of the body 30 may form a part of a circular shape, and the remaining portion of the body 30 may have a shape close to a circular shape in consideration of coupling with other components or elements. In this instance, the circular shape may not mean a complete circle of mathematical meaning, but may mean a circle of engineering meaning with error.

The case 31 may form a side surface and an upper surface of the body 30. The base 32 may form a bottom surface of the body 30.

In the present embodiment, the case 31 may have a cylindrical shape with an open bottom surface. When viewed in a top view, an overall shape of the case 31 may be a circular shape. Since the case 31 has a plane shape of a circular shape, a rotation radius when rotating can be minimized. An outer surface of the case 31 may form at least a part of a circle having a radius having an error with a reference radius within a reference error range.

The case 31 may include an upper wall 311 having an overall shape in a circular shape, and a side wall 312 formed integrally with the upper wall 311 and extending downward from an edge of the upper wall 311.

A part of the sidewall 312 may be open. An opened portion of the side wall 312 may be defined as a water-tank insertion opening (a water-tank insertion hole or a water-tank insertion portion) 313, and a water tank 81 may be detachably installed through the water-tank insertion opening 313. The water-tank insertion opening 313 may be disposed at a rear side based on the traveling direction of the cleaner. Since the water tank 81 is inserted through the water-tank insertion opening 313, the water-tank insertion opening 313 may be preferably disposed close to the mop module 40.

The mop module 40 may be coupled to the base 32. The sweep module 2000 may be coupled to the base 32. A controller Co and a battery Bt may be disposed in an inner space formed by the case 31 and the base 32. In addition, a mop driving unit (a mop driver) 60 may be disposed on the body 30. A water supply module 80 may be disposed at the body 30.

The base 32 may include a base body 321, a base guard 322, and an insertion hole 323. The base body 321 may cover the opened bottom surface of the case 31. The base guard 322 may be formed along an outer edge of the base body 321 and protrude downward from the edge of the base body 321. The insertion hole 323 may penetrate through the base body 321 in an up-down direction, and the sweep module 2000 may be detachably inserted into the insertion hole 323.

Figure 5:
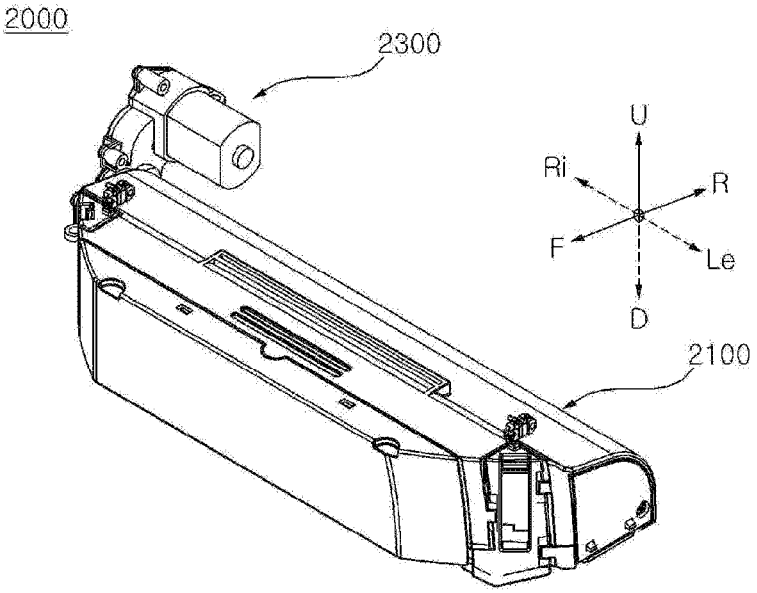
FIG. 5 is a perspective view of a sweep module shown in FIG. 3.
Figure 6:
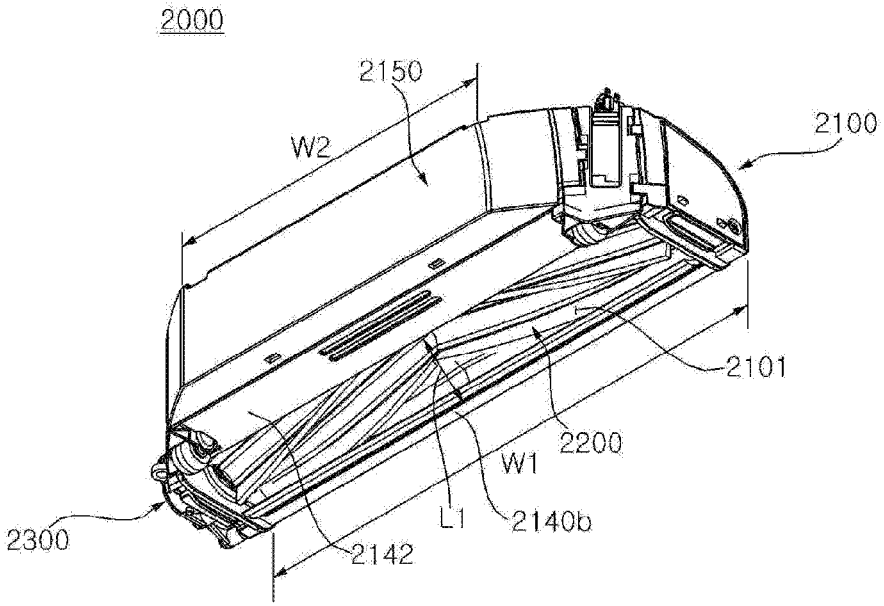
FIG. 6 is a bottom perspective view of the sweep module shown FIG. 5.
Figure 7:
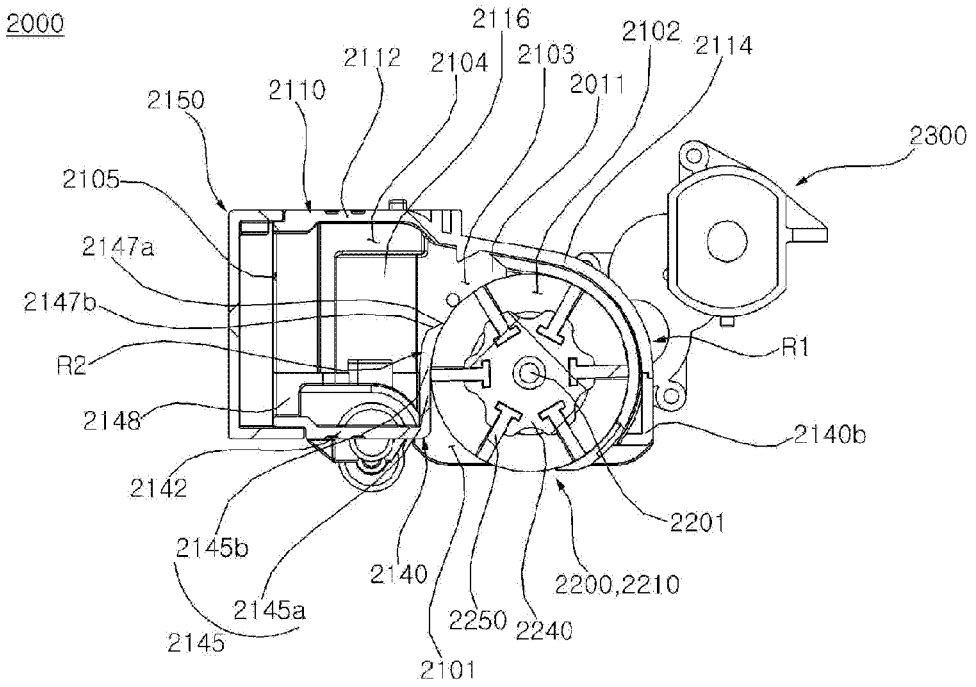
FIG. 7 is a right cross-sectional view of the sweep module shown in FIG. 5.
Figure 8:
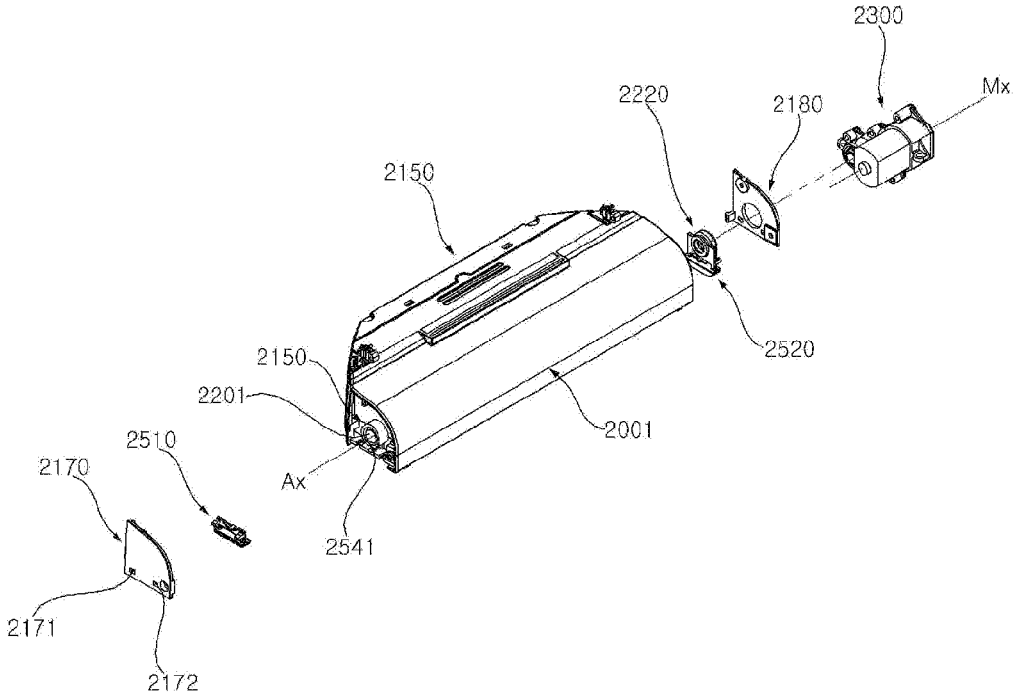
FIG. 8 is an exploded perspective view of the sweep module shown in FIG. 3.
Figure 9:
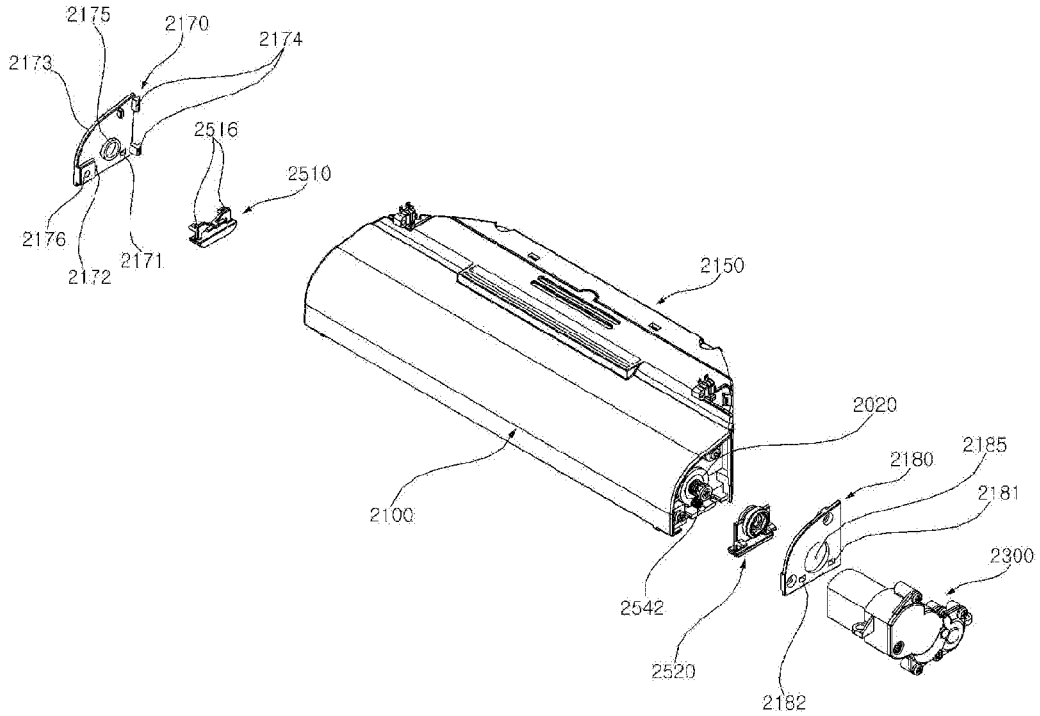
FIG. 9 is an exploded perspective view of the sweep module viewed from a right side of FIG. 8.
Figure 10:
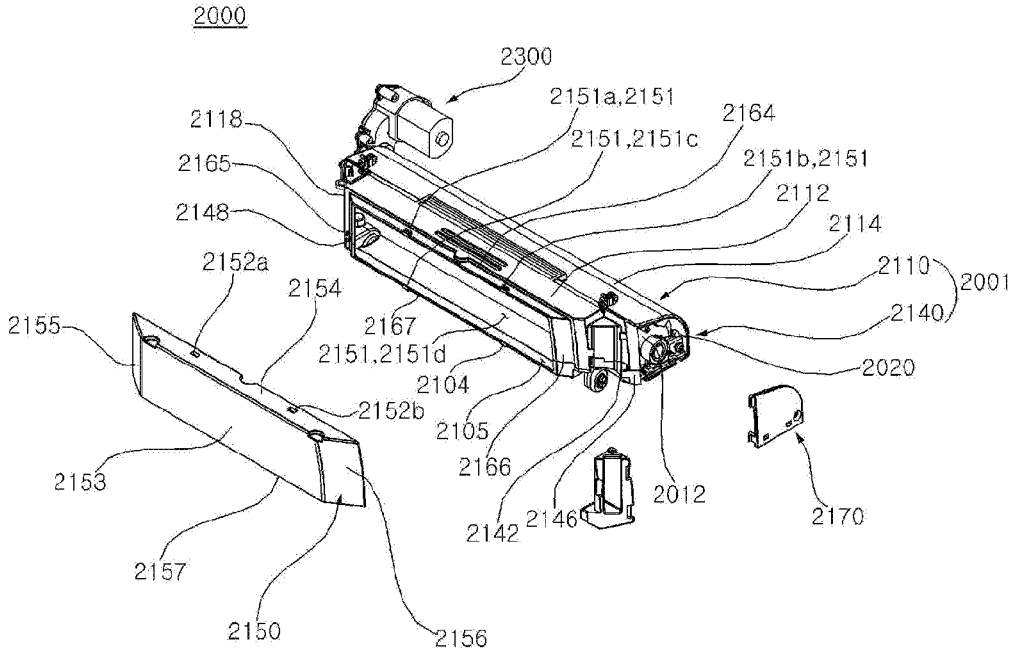
FIG. 10 is a partially exploded perspective view of the sweep module shown in FIG. 5.

FIG. 5 is a perspective view of the sweep module shown in FIG. 3. FIG. 6 is a bottom perspective view of the sweep module shown FIG. 5. FIG. 7 is a right cross-sectional view of the sweep module shown in FIG. 5. FIG. 8 is an exploded perspective view of the sweep module shown in FIG. 3. FIG. 9 is an exploded perspective view of the sweep module viewed from a right side of FIG. 8. FIG. 10 is a partially exploded perspective view of the sweep module shown in FIG. 5.

With reference to FIG. 5 to FIG. 10, the sweep module 2000 may be detachably mounted or installed on the body 30 through the insertion hole 323. The sweep module 2000 may be positioned at a front side than the mop module 40 and collect a foreign material at the front side of the mop module 40. The sweep module 2000 may be detachably assembled with the base 32. The sweep module 2000 in an assembled state with the base 32 may be separated from the base 32 through a lever 2500.

An installation space 325 in which the sweep module 2000 is mounted is formed at the base 32. In the present embodiment, a storage housing 326 forming the installation space 325 may be further provided. The storage housing 326 may be assembled with the base 32 and may be disposed at an upper side of the insertion hole 323.

The storage housing 326 may protrude to an upper side from the base body 321.

A lower side of the storage housing 326 may be opened to communicate with the insertion hole 323. An interior space of the storage housing 326 provides the installation space 325. The installation space 325 of the storage housing 326 corresponds to a shape of the sweep module 2000.

The sweep module 2000 may include a dust housing 2100, an agitator 2200, a driving unit 2300, a driving coupling 2320, a driven coupling 2220, and a lever 2500. The dust housing 2100 may be detachably assembled with the body 30, and a foreign material may be stored in the dust housing 2100. The agitator 2200 may be rotatably assembled with the dust housing 2100. The driving unit 2300 may be installed on the body 30 and provide rotational force to the agitator 2200. The driving coupling 2320 may be disposed at the driving unit 2300 and transmit the rotational force of the driving unit 2300 to the agitator 2200. The driven coupling 2220 may transmit the rotational force of the driving coupling 2320 to the agitator 2200. The lever 2500 may be disposed at the dust housing 2100. The lever 2500 may couple or separate the driving coupling 2320 and the driven coupling 2220 by receiving operation force.

The dust housing 2100 accommodates the agitator 2200. A foreign material collected through the rotation of the agitator 2200 may be stored in the dust housing 2100. That is, the dust housing 2100 provides an installation and operation structure of the agitator 2200, and also provides a storage space for a foreign material.

The dust housing 2100 may include a collection space 2102 for a rotation of the agitator 2200 and a storage space 2104 for storing a foreign material. The dust housing 2100 may longitudinally extend in a left-right direction. A width of the dust housing 2100 may be narrower than a width of the mop module 40.

The dust housing may be formed by separately fabricating a structure for the collection space 2102 and a structure for the storage space 2104 and assembling them each other. In the present embodiment, the collection space 2102 and the storage space 2104 are disposed in the dust housing 2100, and a partition 2145 for partitioning the collection space 2102 and the storage space 2104 may be disposed.

In the present embodiment, the dust housing 2100 may include an upper housing 2110, a lower housing 2140, a dust cover 2150. The upper housing 2110 may provide an upper outer shape. The lower housing 2140 may be disposed at a lower side of the upper housing 2110 and be coupled to the upper housing 2110. The dust cover 2150 may detachably assembled with at least one of the upper housing 2110 and the lower housing 2140.

The collection space 2102 and the storage space 2104 are formed by assembling the upper housing 2110 and the lower housing 2140. That is, the upper housing 2110 may provide an upper partial space of the collection space 2102 and an upper partial space of the storage space 2104, and the lower housing 2140 may provide the remaining lower space of the collection space 2102 and the remaining lower space of the storage space 2014.

In the present embodiment, the collection space 2102 may be positioned at a rear side of the storage space 2104.

That is, the storage space 2104 is positioned at a front side of the collection space 2102, and the dust cover 2150 is positioned at a front side than the upper housing 2110.

In addition, the storage space 2014 may be disposed at a front side of the agitator 2200. When the body of the cleaner has a circular shape or a shape close to a circular shape, rotation in place is easy. When the rotation in place is easy, the cleaner can easily escape from an obstacle area or a corner. However, when the body of the cleaner has a circular shape, a width of an agitator is limited to be smaller than a diameter of the body so that the agitator is not disturbed by the obstacle during the body rotates. Accordingly, in the present disclosure, rotation of the body can be easy by limiting the width of the agitator to be smaller than the diameter of the body. Also, the width of the agitator can be maximized in a state that the agitator does not protrude from the body by disposing the storage space that stores a foreign material collected from the agitator at a front side than the agitator. Therefore, a size of an area to be cleaned at once is not reduced.

The upper housing 2110 and the lower housing 2140 may be integrally assembled. The upper housing 2110 and the lower housing 2140 that are integrally assembled may be defined as a housing assembly 2001.

The dust cover 2150 is detachably assembled with the housing assembly. When the dust cover 2150 is separated from the housing assembly, the storage space 2104 is exposed to an outside. The foreign material stored in the storage space 2104 may be discarded when the dust cover 2150 is separated.

The upper housing 2110 provides an upper surface, a left upper surface, a right upper surface, and a rear surface of the dust housing 2100. The upper housing 2110 forms an upper side of the collection space 2102 and the storage space 2104. The upper housing 2110 provides upper partial portions of the collection space 2102 and the storage space 2104.

The upper housing 2110 may include a first upper housing portion 2112, a second upper housing portion 2114, a third upper housing portion 2116, and a fourth housing portion 2118. The first upper housing portion 2112 may form an upper wall of the storage space 2104. The second upper housing portion 2114 may be integrally connected with the first upper housing portion 2112 and forms an upper wall and a rear wall of the collection space 2102. The third upper housing portion 2116 may provide a part of a left wall of the collection space 2102 and the storage space 2104, and the fourth upper housing portion 2118 may provide a part of a right wall of the collection space 2102 and the storage space 2104.

A shape of the first upper housing 2112 is not limited. However, since the second upper housing portion 2114 accommodates the agitator 2200, the second upper housing portion 2114 may have a shape corresponding to a shape of the agitator 2200.

At least a part of the second upper housing portion 2114 may have a curvature center at a rotation axis of the agitator 2200. At least a part of the second upper housing portion 2114 may have an arc shape.

In the present embodiment, the second upper housing portion 2114 may have a radius of curvature R1 greater than a diameter of the agitator 2200. An outer edge of the agitator 2200 may be preferably in contact with an inner surface of the second upper housing portion 2114.

A foreign material collected through a contact of the agitator 2200 and the second upper housing portion 2114 may be moved to the storage space 2104 along the inner surface of the second upper housing portion 2114. When the agitator 2200 and the second upper housing 2114 are spaced apart from each other, the foreign material collected by the agitator 2200 may fall back to the floor.

A collection opening surface 2101 may be formed at the lower housing 2140. The collection opening surface 2101 may be exposed to the floor. The agitator 2200 may penetrate the collection opening surface 2101 and protrude to a down side than the collection opening surface 2101.

The collection opening surface 2101 may be disposed at a rear side than the storage space 2102.

The lower housing 2140 may be disposed at a lower side of the upper housing 2110 and may be spaced apart from the upper housing 2110 to form a storage opening surface 2103. In the present embodiment, the lower housing 2140 and the upper housing 2110 may be spaced apart from each other in the up-down direction.

The lower housing 2140 may include a first lower housing portion 2142, a third lower housing portion 2146, a fourth lower housing portion 2148, and a partition 2145. The first lower housing portion 2142 may form a lower wall of the storage space 2104 and has the collection opening surface 2101 where the foreign material is collected. The third lower housing portion 2146 may provide a rest of the left wall of the collection space 2102 and the storage space 2104, and the fourth lower housing portion 2148 may provide a rest of the right wall of the collection space 2102 and the storage space 2104, The partition 2145 may be integral with the first lower housing portion 2142, and may partition the collection space 2102 and the storage space 2104.

In the present embodiment, the first lower housing portion 2142, the third lower housing portion 2146, the fourth lower housing portion 2148, and the partition 2145 may be formed to have an integral structure. Unlike the present embodiment, any one of the first lower housing portion 2142, the third lower housing portion 2146, the fourth lower housing portion 2148, or the partition 2145 may be separately manufactured and then be assembled.

A left wall 2011 of the housing assembly 2001 may be provided through assembling the third lower housing portion 2146 and the third upper housing portion 2116. A right wall 2012 of the housing assembly 2001 may be provided through assembling the fourth lower housing portion 2148 and the fourth upper housing portion 2118.

A left rotation axis of the agitator 2200 may penetrate the left wall 2011 of the housing assembly, and a right rotation axis of the agitator 2200 may penetrate the right wall 2012 of the housing assembly.

The partition 2145 may protrude to an upper side from the first lower housing portion 2142. A length of the partition 2145 in the left-right direction may correspond to or relate to a length of the agitator 2200 in the left-right direction. The length of the partition 2145 in the left-right direction may be greater than the length of the agitator 2200 in the left-right direction.

The partition 2145 may include a first partition portion 2145*a* and a second partition portion 2145*b*. The first partition portion 2145*a* may protrude to an upper side from the first lower housing portion 2142, form the collection opening surface 2101, and partition the collection space 2102 and the storage space 2104. The first partition portion 2145*a* may be not in contact with the agitator 2200. The second partition portion 2145*b* may extend to an upper side from the first partition portion 2145*a*, partition the collection space 2102 and the storage space 2104, and be in contact with the agitator 2200.

The first partition portion 2145*a* may protrude to the upper side from the first lower housing portion 2142. The collection opening surface 2101 may be formed between the first partition portion 2145*a* and a rear end 2140*b* of the first lower housing portion 2142.

A length L1 of the collection opening surface 2101 in a front-rear direction may be smaller than a diameter of the agitator 2200. Since the length L1 of the collection opening surface 2101 in the front-rear direction is smaller than the diameter of the agitator 2200, the agitator 2200 cannot be drawn out to an outside through the collection opening surface 2101.

The agitator 2200 may be mounted on an upper side of the lower housing portion 2140, and a lower end of the agitator 2200 may protrude to an outside of the collection opening surface 2101 and thus may be in contact with the floor.

The first partition portion 2145*a* may be not in contact with the agitator 2200.

However, the second partition portion 2145*b* may be in contact with the agitator 2200.

The second partition portion 2145*b* may have an arc shape. A curvature center of the second partition 2145*b* may be positioned at a rotation axis Ax of the agitator 2200. A radius of curvature R2 of the second partition 2145*b* may be equal to or smaller than a diameter of the agitator 2200.

The second partition portion 2145*b* may have a curved surface facing the agitator 2200. An upper end 2147*a* of the second partition portion 2145*b* may be positioned higher than the rotation axis Ax of the agitator 2200.

The upper end 2147*a* of the second partition portion 2145*b* may protrude to a rear side of the first partition portion 2145*a*.

The upper end 2147*a* of the second partition portion 2145*b* may be sharply formed. An inclined surface 2147*b* may be formed at the upper end 2147*a* of the second partition portion 2145*b*. The inclined surface 2147*b* may separate a foreign material attached to a surface of the agitator 2200 and guide the foreign material to the storage space 2104.

When assembling the upper housing 2110 and the lower housing 2140, a discharge surface 2105 that is opened to a front side may be formed. The discharge surface 2105 may be formed at a front surface of the housing assembly 2001, and a dust cover 2150 may open and close the discharge surface 2105.

The dust cover 2150 may be disposed at a front side of the housing assembly 2001 and may cover the discharge surface 2105. The foreign material in the storage space 2104 may be discharged to an outside of the sweep module 2000 through the discharge surface 2105.

The dust cover 2150 may be detachably assembled with the housing assembly 2001. In the present embodiment, the dust cover 2150 and the housing assembly 2001 may be assembled through a mutually-engaged structure (a mutually-fastened structure, a mutually-locked structure, or a mutually-hooked structure). The mutually-engaged structure may be released by operation force of a user.

For the mutually-engaged structure of the dust cover 2150 and the housing assembly 2001, a protrusion 2151 may be formed at one of the dust cover 2150 and the housing assembly 2001, and an engaged groove 2152 may be formed at the other of the dust cover 2150 and the housing assembly 2001.

In the present embodiment, the engaged groove 2152 is formed at the dust cover 2150, and the protrusion 2151 is formed at the housing assembly 2001.

A number of engaged grooves 2152 corresponds to a number of protrusions 2151. A plurality of protrusions 2151 may be disposed. The protrusions 2151 may be disposed at the upper housing 2110 and the lower housing 2140, respectively.

In the present embodiment, two protrusions 2151 are disposed at the upper housing 2110, and two protrusions 2151 are also disposed at the lower housing 2140.

If it is necessary to distinguish, protrusions disposed at the upper housing 2110 are referred to as upper protrusions 2151*a* and 2151*b*, and protrusions disposed at the lower housing 2140 are referred to as lower protrusions 2151*c* and 2151*d*.

The upper protrusions 2151*a* and 2151*b* protrude to an upper side at an upper surface of the upper housing 2110. The lower protrusion 2151*c* and 2151*d* protrude to a lower side at a bottom surface of the lower housing 2140.

At the dust cover 2150, upper engaged grooves 2152*a* and 2152*b* corresponding to the upper protrusions 2151*a* and 2151*b* are formed, and lower engaged groove 2152*c* and 2152*d* corresponding to the lower protrusions 2151*c* and 2151*d* are formed.

The dust cover 2150 may include a front cover portion 2153, a top cover portion 2154, a left cover portion 2155, and a right cover portion 2156, and a bottom cover portion 2157. The front cover portion 2153 may be disposed to face the discharge surface 2105. The top cover portion 2154 may protrude from an upper edge of the front cover portion 2153 toward the housing assembly. The left cover portion 2155 may protrude from a left edge of the front cover portion 2153 toward the housing assembly, and the right cover portion 2156 may protrude from a right edge of the front cover portion 2153 toward the housing assembly. The bottom cover portion 2157 may protrude from a lower edge of the front cover portion 2153 toward the housing assembly side.

The dust cover 2150 may have a concave insertion space from a rear side to a front side. The left cover portion 2155 and the right cover portion 2156 may be arranged to be inclined toward the front side.

The upper engaged groove 2152*a* and 2152*b* are formed at the top cover portion 2154. The lower engaged groove 2152*c* and 2152*d* are formed at the bottom cover portion 2157. The upper engaged groove 2152*a* and 2152*b* and the lower engaged groove 2152*c* and 2152*d* may be preferably disposed to be opposite to each other.

The upper engaged groove 2152*a* and 2152*b* or the lower engaged groove 2152*c* and 2152*d* may have a shape of a groove or a hole.

The housing assembly 2001 may have an insertion portion 2160 being inserted into the insertion space and being in close contact with an inner surface of the dust cover 2150. The insertion portion 2160 may be located at a front side of the upper housing 2110 and the lower housing 2140.

The insertion portion 2160 may include a top insertion portion 2164, a left insertion portion 2165, a right insertion portion 2166, and a bottom insertion portion 2167. The top insertion portion 2164 may form an upper side of the discharge surface 2105 and protrude to a front side. The left insertion portion 2165 may form a left side of the discharge surface 2105 and protrude to a front side. The right insertion portion 2166 may form a right side of the discharge surface 2105 and protrude to a front side. The bottom insertion portion 2167 may form a lower side of the discharge surface 2105 and protrude to a front side.

In the present embodiment, the top insertion portion 2164, the left insertion portion 2165, the right insertion portion 2166, and the bottom insertion portion 2167 are connected. Unlike the present embodiment, the top insertion portion 2164, the left insertion portion 2165, the right insertion portion 2166, and the bottom insertion portion 2167 may be separated. An area of the insertion portion 2160 may become narrower as it goes from a rear side to a front side.

The top insertion portion 2164 may be in close contact with the top cover portion 2154, the left insertion portion 2165 may be in close contact with the left cover portion 2155, the right insertion portion 2166 may be in close contact with the right cover portion 2156, and the bottom insertion portion 2167 may be in close contact with the bottom cover portion 2157.

In the present embodiment, the upper protrusions 2151*a* and 2111*b* are formed at the top insertion portion 2164, and the lower protrusions 2151*c* and 2151*d* are formed at the bottom insertion portion 2167.

The upper protrusions 2151*a* and 2151*b* may be inserted into the upper engaged groove 2152*a* and 2152*b* from a lower side to an upper side of the upper engaged groove 2152*a* and 2152*b* to form a mutually-engaged structure. The lower protrusions 2151*c* and 2151*d* may be inserted into the lower engaged groove 2152*c* and 2152*d* from an upper side to a lower side of the lower engaged groove 2152*c* and 2152*d* to form a mutually-engaged structure.

By operation force of a user to pull the dust cover 2150, the dust cover 2150 or the insertion portion 2160 is elastically deformed and thus the mutually-engaged structure is released.

The agitator 2200 may be disposed to be rotated in the housing assembly 2001.

The agitator 2200 may be disposed between the upper housing 2110 and the lower housing 2140. The agitator 2200 may be disposed at the upper housing 2110. In the present embodiment, the agitator 2200 is disposed at the lower housing 2140 and rotates while being supported by the lower housing 2140.

A rotation axis of the agitator 2200 is disposed in the left-right direction and the agitator 2200 may rotate forward or backward.

The housing assembly 2001 may further include a first journal 2010 and a second journal 2020 supporting the agitator 2200. The first journal 2010 is disposed at a left side of the housing assembly 2001, and the second journal 2020 is disposed at a right side of the housing assembly 2001.

The first journal 2010 and the second journal 2020 penetrate the housing assembly 2001 in the left-right direction and communicate with the collection space 2102.

In the present embodiment, the first journal 2010 and the second journal 2020 may have a cylindrical shape. Unlike the present embodiment, at least one of the first journal and the second journal may have a semi-cylindrical shape. When the first journal and the second journal have a semi-cylindrical shape, the first journal and the second journal are arranged to support the rotation axis of the agitator 2200 at a lower side.

The dust housing 2100 may be mounted on the installation space 325 of the base 32, and a lever 2500 may be disposed to couple or separate the base 32 and the dust housing 2100.

Figure 11:
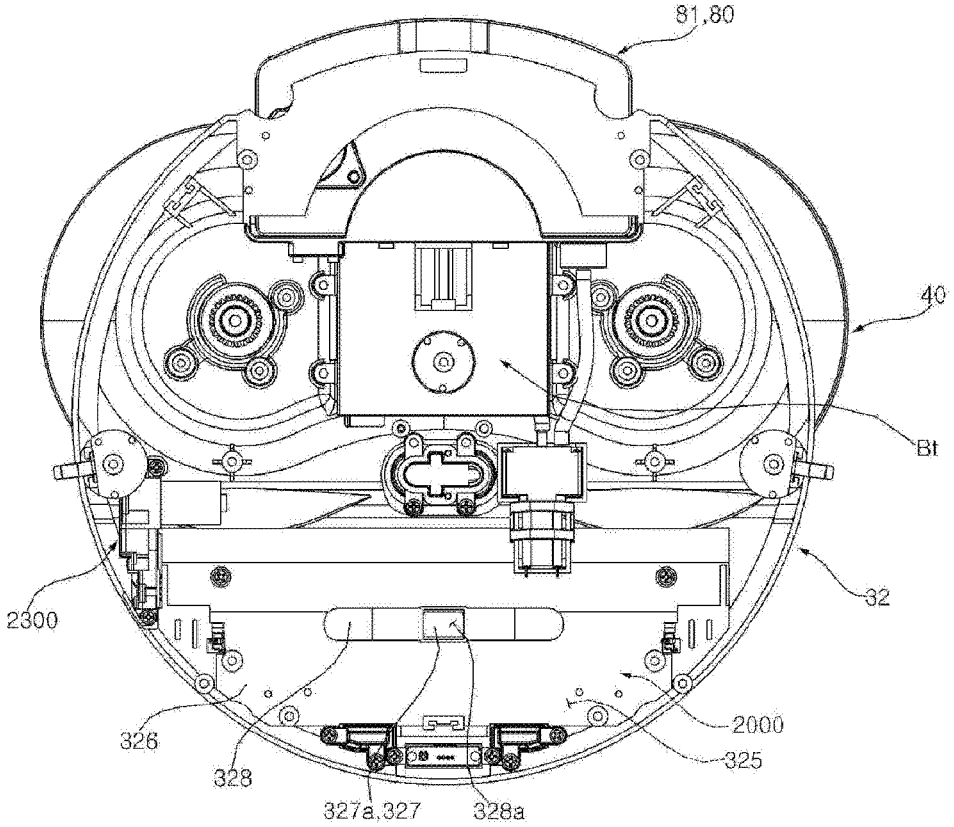
FIG. 11 is a plan view of the cleaner of FIG. 1 in a state that a case is removed.
Figure 12:
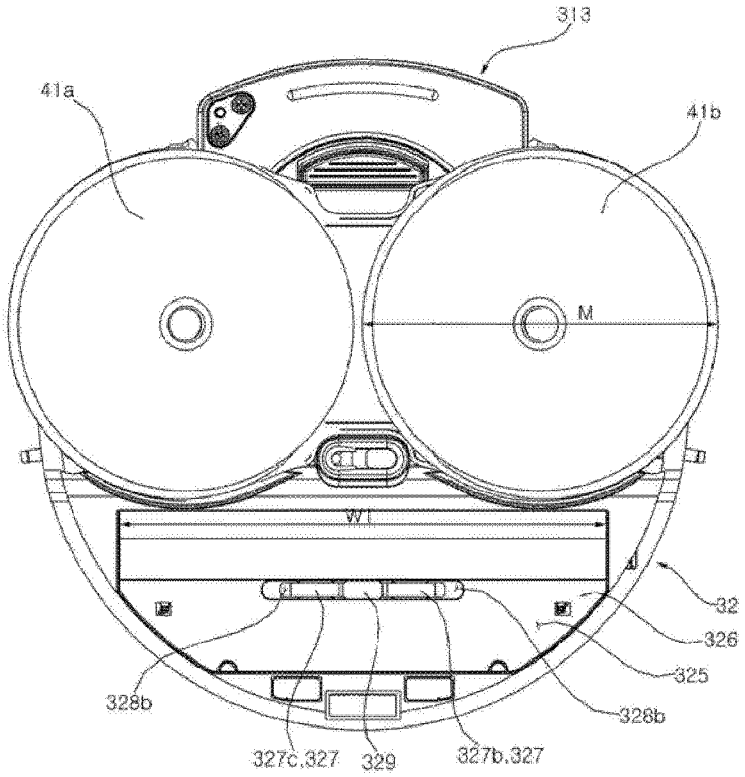
FIG. 12 is a bottom view of the cleaner shown in FIG. 11.
Figure 13:
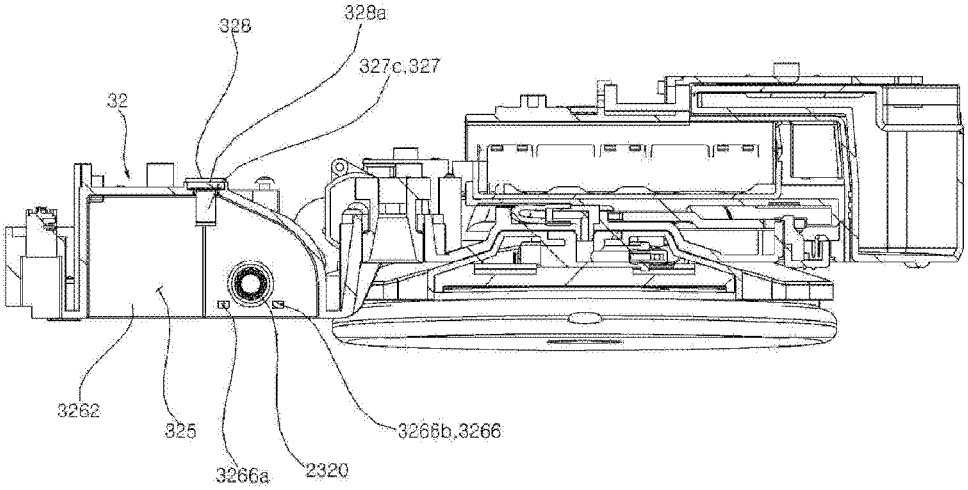
FIG. 13 is a right cross-sectional view of the cleaner shown in FIG. 11.
Figure 14:
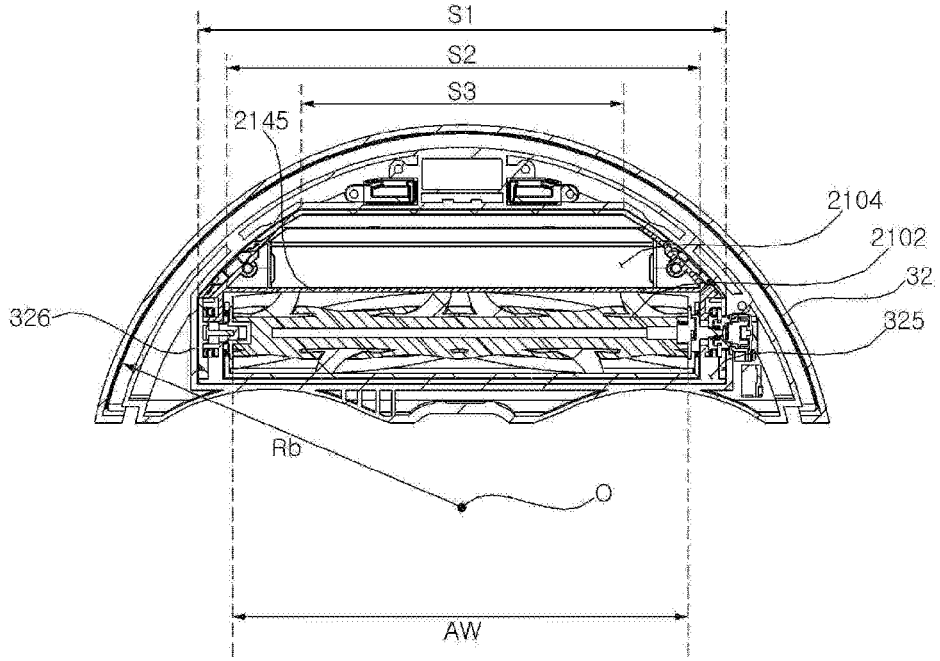
FIG. 14 is a horizontal cross-sectional view showing an inside of an installation space of the cleaner shown in FIG. 1.

FIG. 11 is a plan view of the cleaner of FIG. 1 in a state that a case is removed. FIG. 12 is a bottom view of the cleaner shown in FIG. 11. FIG. 13 is a right cross-sectional view of the cleaner shown in FIG. 11. FIG. 14 is a horizontal cross-sectional view showing an inside of an installation space of the cleaner shown in FIG. 1.

Referring to FIG. 11 to FIG. 14, the sweep module 2000 may further include a housing elastic member 327 that provides elastic force to the dust housing 2100. The housing elastic member 327 may be disposed at the installation space 325.

The housing elastic member 327 may be disposed at the base 32, and more particularly, may be installed on the storage housing 326. In the present embodiment, the housing elastic member 327 may be a plate spring. In order to install the housing elastic member 327 of the plate spring, an installation structure for fitted-fixing may be disposed at the storage housing 326.

The housing elastic member 327 may elastically support an upper surface of the dust housing 2100.

The storage housing 326 is provided with an elastic-member storage portion 328 that protrudes to an upper side to have a convex shape at the installation space 325. An elastic-member storage space 328*b* in which the housing elastic member 327 is accommodated may be formed at a lower side of the elastic-member storage portion 328.

The elastic member storage portion 328 may further include an elastic-member opening surface 328*a* opened in an up-down direction. The elastic-member opening surface 328*a* may communicate with the elastic-member storage space 328*b* and the installation space 325.

In addition, an elastic-member support portion 329, which is disposed at a lower side of the elastic-member storage space 328*b* and is connected to the storage housing 326, may be further disposed.

The elastic-member support portion 329 may be positioned at a lower side than the elastic-member storage portion 328.

The housing elastic member 327 may be inserted between the elastic-member storage portion 328 and the elastic-member support portion 329. The housing elastic member 327 may be exposed to an upper side of the storage housing 326 through the elastic-member opening surface 328*a*.

The housing elastic members 327 may be positioned at both sides of the elastic-member support portion 329, respectively.

The elastic member storage portion 328 may longitudinally extend in the left-right direction, and the elastic-member support portion 329 may be disposed in the left-right direction.

The housing elastic member 327 may include a first elastic portion 327*a*, a second elastic portion 327*b*, and a third elastic portion 327*c*. The first elastic portion 327*a* may be positioned at an upper side of the elastic-member support portion 329. The second elastic portion 327*b* may extend to one side (a left side in the present embodiment) from the first elastic portion 327*a* and be disposed in the elastic-member storage space 328*b*. The third elastic portion 327*c* may extend to the other side (a right side in the present embodiment) from the first elastic portion 327*a* and be disposed in the elastic-member storage space 328*b*.

Each of the second elastic portion 327*b* and the third elastic portion 327*c* may be bent from the first elastic portion 327*a*.

The second elastic portion 327*b* and the third elastic portion 327*c* may be positioned at a lower side of the elastic-member storage portion 328. The second elastic portion 327*b* may be disposed to be inclined toward a left down side, and the third elastic portion 327*c* may be disposed to be inclined toward a right down side.

When the dust housing 2100 is inserted into the installation space 325, the second elastic portion 327*b* and the third elastic portion 327*c* may elastically support an upper surface of the dust housing 2100.

When the mutually-engaged structure of the dust housing 2100 and the base 32 is released by the first lever 2510 and the second lever 2520, the second elastic portion 327*b* and the third elastic portion 327*c* push the dust housing 2100 to a lower side and moves the dust housing 2100 to an outside of the storage housing 326.

By the elastic force of the housing elastic member 327, a user can easily separate the dust housing 2100 from the installation space 325.

Since the elastic-member support portion 329 supports the housing elastic member 327, the housing elastic member 327 can be prevented from being separated to the installation space 325. Even if the dust housing 2100 is repeatedly mounted and separated, the housing elastic member 327 is firmly supported by the elastic-member support portion 329.

An arrangement of a collection space and a storage space of a sweep module will be described in more detail with reference to FIG. 6, FIG. 7, FIG. 13, and FIG. 14.

In the present embodiment, the body 30 may have a circular shape when viewed in a top view. More particularly, a front side or a front portion of the body 30 (a portion at a front side of a traveling direction) may have a circular shape. When a front side F of the body 30 has a circular shape, a rotational radius can be minimized.

More particularly, in the present embodiment, a diameter M of each spin mop 41*a* and 41*b* that moves the cleaner may be larger than a radius of the body 30. When viewed in the top view, since the diameter M of each spin mop 41*a* and 41*b* is larger than the radius of the body 30, a center O of the body 30 is positioned between the spin mops 41*a* and 41*b*.

When the rotation radius of the body 30 is minimized, a volume of the body 30 can be maximized within the same rotation radius, and accordingly, an internal volume of the body 30 can be increased. As the internal volume of the body 30 increases, a volume of the water tank 81 or the storage space 2104 can become larger.

The sweep module 2000 may be positioned at a front side than the map module 40. More particularly, the sweep module 2000 may be positioned at a front side than the spin mops 41*a* and 41*b*, and the collection opening surface 2101 may be positioned at a front side than each spin mop 41*a* and 41*b*. Since the foreign material on a floor is swept through the collection opening surface 2101, each of the spin mops 41*a* and 41*b* should not be overlapped with the collection opening surface 2101. Due to this arrangement, a width W1 of the sweep module 2000 in a left-right direction may be smaller than a diameter of the body 30.

In the present embodiment, the sweep module 2000 may have selectively detachable structure to the installation space 325 formed at the base 32.

Thus, the storage space 2104 and the collection space 2102 of the sweep module 2000 may be disposed at an inside of the installation space 325. The collection space 2102 may be disposed at a rear side than the storage space 2104. When viewed in a top view, the collection space 2102 may be disposed closer to the center O of the body 30 than the storage space 2104.

In the present embodiment, the collection space 2102 and the storage space 2104 may be disposed on the same plane.

In order to maximize a width of the agitator 2200 that determines a cleaning area, the agitator 2200 should be disposed close to the center O of the body 30.

Since the collection space 2102 is disposed closer to the center O of the body 30 having a shape close to a circular shape when viewed in a top view, the storage space 2104 may be disposed at a front side than the collection space 2102.

In the present embodiment, in a structure in which the mop module 40 is disposed at a rear side of the cleaner in the traveling direction and the sweep module 2000 is disposed at a front side of the mop module 40, the storage space 2104 in which the foreign material is stored is positioned at a front side of the collection space 2102.

The agitator 2200 is disposed in a left-right direction and rotated in a front-rear direction. In order to minimize interference with the rotated agitator 2200, a length of the collection space 2102 in the front-right direction may be equal to or larger than a diameter of the agitator 2200.

A maximum width of the sweep module 2000 in the left-right direction is defined as a maximum width W1, and a minimum width of the sweep module 2000 in the left-right direction is defined as a minimum width W2. The maximum width W1 may be a width of the sweep module 2000 in the left-right direction when the first side cover 2170 and the second side cover 2180 of the dust housing 2100 are included. The minimum width W2 may be a width of the front cover portion 2153 of the dust cover 2150 in the left-right direction. The minimum width W2 may be positioned at a front side than the maximum width W1.

When viewed in a top view, since the body 30 may have a shape close to a circular shape, a front side of the sweep module 2000 positioned at a front side than the center O may have an arc shape.

Since the installation space 325 corresponds to the sweep module 2000, a maximum width at a rear side of the installation space 325 may be equal to or larger than the maximum width W1, and a maximum width at a front side of the installation space 325 may be equal to or larger than the minimum width W2.

Since the collection space 2102 and the storage space 2104 are disposed at an inside of the sweep module 2000, widths of the collection space 2102 and the storage space 2104 may be smaller than the maximum width W1.

A maximum width of the installation space 325 is defined as a maximum width S1, and a minimum width of the installation space 325 is defined as a minimum width S3. Since the collection space 2102 and the storage space 2104 are partitioned based on the partition 2145 of the dust housing 2100, a width of the partition 2145 in the left-right direction is defined as a width S2.

The width S2 of the partition 2145 may be smaller than the maximum width S1 of the installation space 325 and may be larger than the minimum width S3 of the installation space 325.

Since the agitator 2200 is disposed at the collection space 2102, a width Aw of the agitator 2000 in the left-right direction may be smaller than a maximum width of the collection space 2102.

The width Aw of the agitator 2000 in the left-right direction may be greater than an interval of spin shafts 414 and may be smaller than a width W1 of the installation space in the left-right direction.

Since the agitator 2200 is disposed at the collection space 2102, when the width of the collection space 2102 in the left-right direction is maximized, the width Aw of the agitator 2000 in the left-right direction may be larger. When the width Aw of the agitator 2000 in the left-right direction is maximized, an area to be cleaned at once can be maximized.

In the present embodiment, since the partition 2145 partitions the collection space 2102 and the storage space 2014, a front-side width S2 of the collection space 2102 may be equal to a rear-side width S2 of the storage space 2104.

Unlike the present embodiment, the front-side width of the collection space 2102 and the rear-side width of the storage space 2104 may be different. In this case, a foreign material collected at both ends of the agitator 2200 may not be moved to the storage space 2014.

In order to maximally utilize the width Aw of the agitator 2000 in the left-right direction, the rear-side width S2 of the storage space 2104 may be the same as the front-side width S2 of the collection space 2102, as in the present embodiment. Due to a thickness of the dust housing 2100 in a manufacturing process, the rear-side width S2 of the storage space 2104 may be slightly smaller.

The width Aw of the agitator 2000 in the left-right direction may be smaller than an interval between the left wall 2011 and the right wall 2012 of the dust housing 2100.

Figure 15:
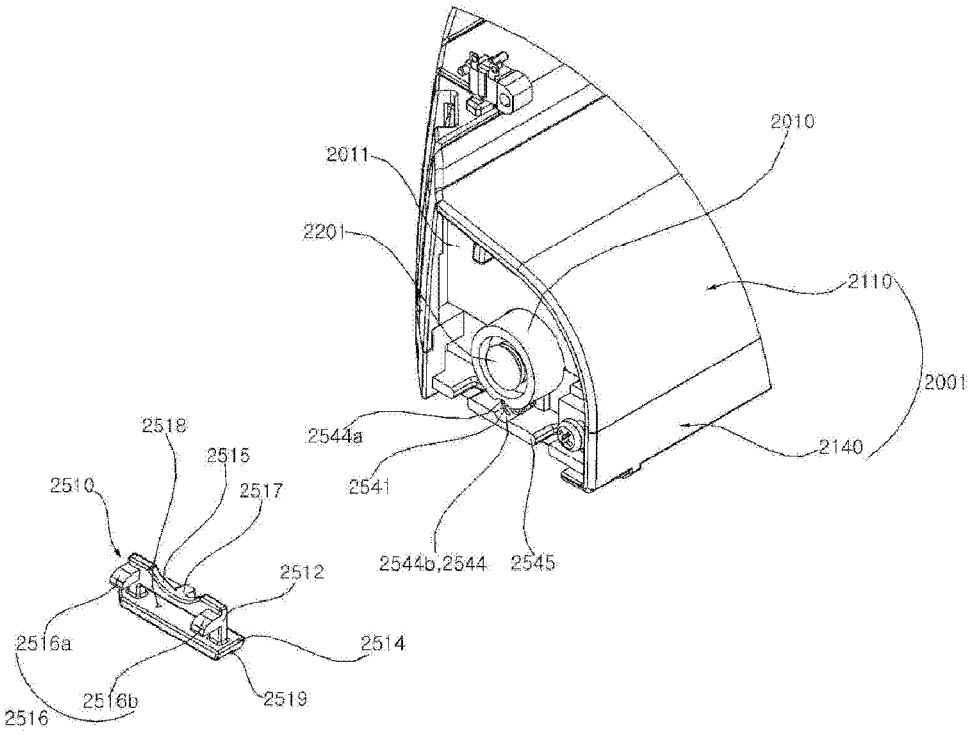
FIG. 15 is an enlarged perspective view of a first lever shown in FIG. 8.
Figure 16:
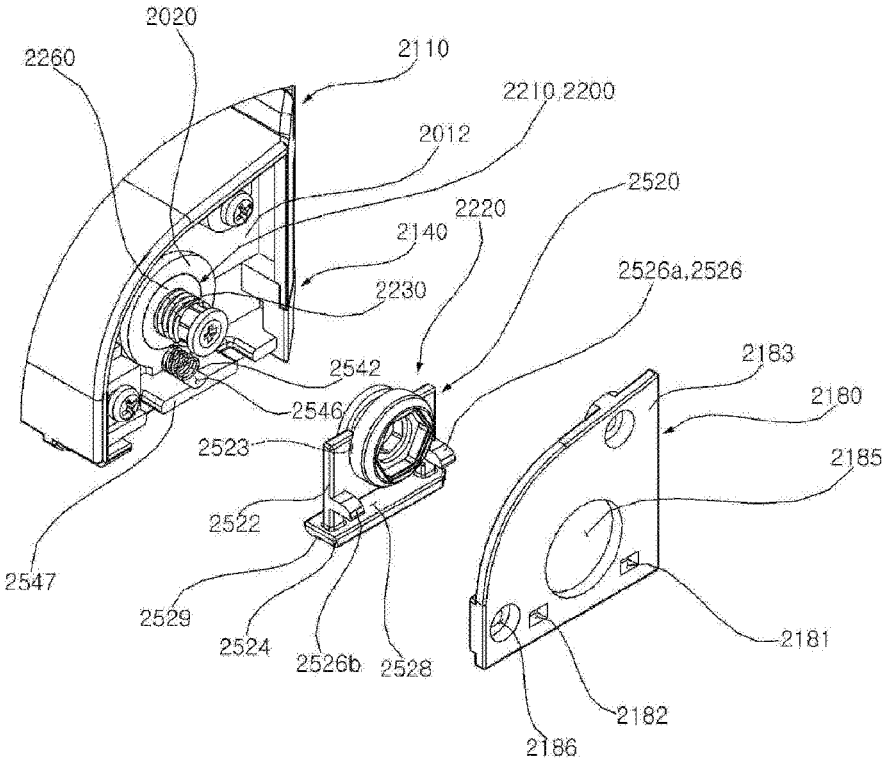
FIG. 16 is an enlarged perspective view of a second lever shown in FIG. 9.
Figure 17:
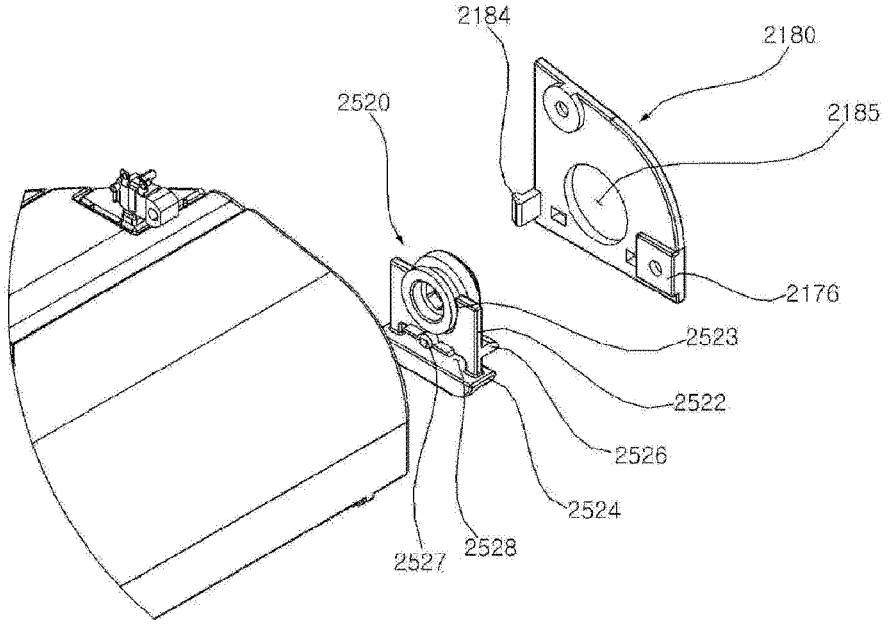
FIG. 17 is an enlarged perspective view of the second lever viewed from a left side of FIG. 16.

FIG. 15 is an enlarged perspective view of the first lever shown in FIG. 8. FIG. 16 is an enlarged perspective view of the second lever shown in FIG. 9. FIG. 17 is an enlarged perspective view of the second lever viewed from a left side of FIG. 16.

Referring to FIG. 9, FIG. 10, and FIG. 15 to FIG. 17, the lever 2500 may be disposed between the base 32 and the dust housing 2100 and may form a mutually-engaged structure with respect to the base 32 and the dust housing 2100. The lever 2500 may form a mutually-engaged structure with the dust housing 2100 in a direction of gravity and suppress the dust housing 2100 from being separated from a lower side of the base 32.

A plurality of levers 2500 may be disposed, and form a mutually-engaged structure at a plurality of places of the dust housing 2100. In the present embodiment, the lever 2500 includes a first lever 2510 and a second lever 2520, and the first lever 2510 and the second lever 2520 are arranged in the left-right direction.

The first lever 2510 is disposed at a left side of the dust housing 2100, and the second lever 2520 is disposed at a right side of the dust housing 2100.

Operation mechanisms of the first lever 2510 and the second lever 2520 are the same, and only operation directions of the first lever 2510 and the second lever 2520 are opposite to each other.

The first lever 2510 disposed at the left side is moved to the right side to release the mutually-engaged structure with the base 32, and the second lever 2520 disposed at the right side is moved to a left side to release the mutually-engaged structure with the base 32.

The sweep module 2000 may include a first lever 2510, a second lever 2520, a first-lever elastic member 2541, and a second-lever elastic member 2542. The first lever 2510 may be disposed at one side of the housing assembly to be relatively movable in the left-right direction. The second lever 2520 may be disposed at the other side of the housing assembly to be relatively movable in the left-right direction. The first-lever elastic member 2541 may be disposed between the first lever 2510 and the dust housing 2100 and provide elastic force to the first lever 2510. The second-lever elastic member 2252 may be disposed between the second lever 2520 and the dust housing 2100 and provide elastic force to the second lever 2520.

Since the first lever 2510 and the second lever 2520 may have the same or similar structures, a structure of the first lever will be described as an example.

In the present embodiment, the dust housing 2100 may be provided with a first side cover 2170 covering or shielding the first lever 2510 and a second side cover 2180 covering or shielding the second lever 2520.

Unlike the present embodiment, the first lever 2510 and the second lever 2520 may be exposed to an outside of the dust housing 2100 without the first side cover 2170 and the second side cover 2180. Also, unlike the present embodiment, the first side cover 2170 may be disposed at a right side and the second side cover 2180 may be disposed at a left side.

The first side cover 2170 may be coupled to a left side of the housing assembly 2001. The first side cover 2170 may have a shape corresponding to a left shape of the housing assembly 2001. The first side cover 2170 may shield a shaft member 2201 of the agitator 2200 from being exposed to an outside. The first side cover 2170 may cover or shield most of the first lever 2510 and exposes only a portion for the mutually-engaged structure with the base 32.

The first side cover 2170 may include a first side cover body 2173, a through hole 2171 or 2172, a hook portion 2174, a journal-coupled portion 2175, and a fastening portion 2176. The first side cover body 2173 may be in close contact with one side of the housing assembly 2001. The through hole 2171 or 2172 may be disposed to penetrate the first side cover body 2173. The hook portion 2174 may protrude from the first side cover body 2173 toward the housing assembly 2001 and may be hooked-coupled with the housing assembly 2001. The journal-coupled portion 2175 may protrude from the first side cover body 2173 toward the housing assembly 2001 and be mutually coupled to the journal 2010 (the first journal 2010 in the present embodiment). The fastening portion 2176 may couple the first side cover body 2173 and the housing assembly 2001 by a fastening member (not shown).

The fastening portion 2176 and the hook portion 2174 are disposed at opposite sides based on the journal-coupled portion 2175. A plurality of hook portions 2174 may be arranged in an up-down direction.

The journal-coupled portion 2175 may be inserted into an inner diameter of the first journal 2010.

The first lever 2510 may include an upper lever body 2512, a lower lever body 2514, and a lever engaging portion 2516. The upper lever body 2512 may be disposed between the housing assembly 2001 and the first side cover 2170 and be elastically supported by the first-lever elastic member 2541. The lower lever body 2514 may be disposed between the housing assembly 2001 and the first side cover 2170, be integral with the upper lever body 2512, be exposed to an outside of the housing assembly 2001, and receive operation force of a user. The lever engaging portion 2516 may protrude from the upper lever body 2512 and be disposed to penetrate the through holes 2171 and 2172 of the first side cover 2170.

The upper lever body 2512 may be disposed in an up-down direction, and the lower lever body 2514 may be disposed in a horizontal direction.

The lower lever body 2514 may be disposed to be exposed to an outside of the dust housing 2100. The lower lever body 2514 may be positioned at a lower side of the upper lever body 2512. The lower lever body 2514 may be exposed to an outside of a lower surface of the lower housing 2140.

In the present embodiment, an operation portion 2519 protruding to a lower side from the lower lever body 2514 may further provided. Since the operation portion 2519 longitudinally extends in the front-rear direction, the operation portion 2519 may easily receive operation force of a user in the left-right direction.

A user may move the first lever 2510 by pushing the operation unit 2519 in the left-right direction.

The lever engaging portion 2516 may protrude from the upper lever body 2512 to an outside (a side opposite to the agitator). Since a number of the lever engaging portions 2516 corresponds to a number of through holes, a first lever engaging portion 2516*a* and a second lever engaging portion 2516*b* are disposed in the present embodiment.

The lever engaging portion 2516 has a structure that forms a mutually-engaged structure in a direction of gravity and minimizes forming a mutually-engaged structure in an opposite direction of gravity. Therefore, an upper surface of the lever engaging portion 2516 may have a round shape or an inclined surface to a lower side, and a lower surface of the lever engaging portion 2516 may have a flat surface.

If the levers 2510 and 2520 are not returned to initial positions when the levers 2510 and 2520 move, the sweep module 2000 may be separated from a fixed position because the mutually engaged structure is not formed. To prevent this, the sweep module 2000 may further include a structure for guiding a horizontal movement of the first lever 2510.

The sweep module 2000 may include a first guide 2545, a first guide hole 2518, a second guide 2547, and a second guide hole 2528. The first guide 2545 may protrude to the first lever 2510 at one side (a left side in the present embodiment) of the dust housing 2100 and mutually interfere with the first lever 2510 to guide a movement direction of the first lever 2510. The first guide hole 2518 may be formed at the first lever 2510, and the first guide 2545 may be inserted into the first guide hole 2518 so that the movement of the first guide 2545 is guided. The second guide 2547 may protrude to the second lever 2520 at the other side (a right side in the present embodiment) of the dust housing 2100 and mutually interfere with the second lever 2520 to guide a movement direction of the second lever 2520. The second guide hole 2528 may be formed at the second lever 2520, and the second guide 2547 may be inserted to the second guide hole 2528 so that the movement of the second guide 2547 is guided.

The first guide 2545 may be formed in the movement direction of the first lever 2510, and the second guide 2547 may be formed in the moving direction of the second lever 2520. Thus, the first guide 2545 and the second guide 2547 may be formed in a horizontal direction. The first guide hole 2518 and the second guide hole 2528 may be formed in the horizontal direction to correspond to the first guide 2545 and the second guide 2547.

The guide holes 2518 and 2528 may be disposed at either the upper lever body 2512 or the lower lever body 2514. In the present embodiment, the guide holes 2518 and 2528 are formed to penetrate the upper lever body 2512 in the horizontal direction.

One end of the first-lever elastic member 2541 is supported by the dust housing 2100, and the other end of the first-lever elastic member 2541 is supported by the first lever 2510. The first-lever elastic member 2541 elastically supports the first lever 2510 toward an outside of the dust housing 2100.

The sweep module 2000 may further include a structure for preventing displacement of the lever elastic members 2541 and 2542.

In order to maintain an operation position of the first-lever elastic member 2541, the sweep module 2000 may include a first position fixing portion 2517 and a second position fixing portion 2544. The first position fixing portion 2517 may be disposed at the first lever 2510 and may be inserted into the other end of the first-lever elastic member 2541. The second position fixing portion 2544 may be disposed at the dust housing 2100 and one end of the first-lever elastic member 2541 may be inserted into the second position fixing portion 2544.

In the present embodiment, the first-lever elastic member 2541 and the second-lever elastic member 2542 may be formed of a coil spring. In the present embodiment, the first position fixing portion 2517 may have a boss shape, and the second position fixing portion 2544 may have a groove shape.

The first position fixing portion 2517 may be inserted into the first-lever elastic member 2541, and the first position fixing portion 2517 may allow the first-lever elastic member 2541 to move in the left-right direction. Thus, a movement of the first-lever elastic member 2541 in the front-rear direction or in the up-down direction may be suppressed.

The second position fixing portion 2544 may have a groove shape, and the first-lever elastic member 2541 may be inserted into the second position fixing portion 2544. The second position fixing portion 2544 may allow the first-lever elastic member 2541 to move in the left-right direction. Thus, a movement of the first-lever elastic member 2541 in the front-rear direction or in the up-down direction may be suppressed.

In the present embodiment, the second position fixing portion 2544 may be disposed between the first journal 2010 and the first guide 2545. The second position fixing portion 2544 may include a first position fixing part 2544*a* and a second position fixing part 2544*b*. The first position fixing part 2544*a* may have a concave shape at a portion of a lower side of the first journal 2010, and the second position fixing part 2544*b* may have a concave shape at a portion of an upper side of the first guide 2545.

When viewed from a later side, each of the first position fixing part 2544*a* and the second position fixing part 2544*b* may have a curved surface, and a curvature center of each of the first position fixing part 2544*a* and the second position fixing part 2544*b* may be positioned at an inside of the first-lever elastic member 2541.

A radius of curvature of each of the first position fixing part 2544*a* and the second position fixing part 2544*b* may be larger than a diameter of the first-lever elastic member 2541.

When the first lever 2510 is moved toward the housing assembly 2001 by operation force of a user, the lever engaging portion 2516 releases the mutually-engaged structure with the base 32. In this instance, since the first-lever elastic member 2541 elastically supports the first lever 2510, when the operation force of the user is removed, the first lever 2510 is moved back to the first side cover 2170 and the lever engaging portions 2516 are exposed to an outside of the through holes 2171 and 2172.

The sweep module 2000 may be maintained in a state mounted on the base 32 through the mutually-engaged structure of the lever engaging portion 2516 protruding to an outside of the through holes 2171 and 2172 and the base 32.

When the mutually-engaged structure between the lever engaging portion 2516 and the base 32 is released, the sweep module 2000 can be separated from the base 32.

In the present embodiment, since the first lever 2510 and the second lever 2520 are disposed at the left and right sides of the sweep module 2000, respectively, the sweep module 2000 can be separated from the body 30 only when both of the mutual engagements of the first lever 2510 and the second lever 2520 are released.

The first lever 2510 provides the mutually-engaged structure with the base 32 and releases the mutually-engaged structure with the base 32. The second lever 2520 provides not only an act of the first lever 2510 but also a connection structure with the driving unit 2300.

The second lever 2520 may include an upper lever body 2522, a lower lever body 2524, a lever engaging portion 2526, and an operation portion 2529. The upper lever body 2522 may be disposed between the housing assembly 2001 and the second side cover 2180 and be elastically supported by the second-lever elastic member 2542. The lower lever body 2524 may be disposed between the housing assembly 2001 and the second side cover 2180, be integral with the upper lever body 2522, be exposed to an outside of the housing assembly 2001, and receive operation force of a user. The lever engaging portion 2526 may protrude from the upper lever body 2522 and be disposed to penetrate through holes 2181 and 2182 of the second side cover 2180. The operation portion 2529 may protrude to a lower side from the lower lever body 2524.

When it is necessary to distinguish the lever engaging portion 2516 of the first lever from the lever engaging portion 2526 of the second lever, the lever engaging portion 2516 of the first lever is referred to as one-side lever engaging portion, and the lever engaging portion 2526 of the second lever is referred to as the other-side lever engaging portion.

The lever engaging portion 2526 may protrude from the lower lever body 2522 to an outside (a side opposite to the agitator). The lever engaging portion 2526 may include a first lever engaging portion 2526*a* and a second lever engaging portion 2526*b*.

The lever engaging portion 2526 may form a mutually-engaged structure with an engaged groove 3266 formed at the storage housing 326 of the base 32.

Since the lever engaging portion 2526 includes the first lever engaging portion 2526*a* and the second lever engaging portion 2526*b*, the engaged groove 3266 may include a first engaged groove 3266*a* and a second engaged groove 3266*b* to correspond to them. With respect to the lever engaging portion 2516 of the first lever 2510, an engaged groove (not shown) having the same structure may be formed. The first engaged groove 3266*a* and the second engaged groove 3266*b* may be formed at a sidewall 3262 of the storage housing 326.

The first engaged groove 3266*a* and the second engaged groove 3266*b* may be positioned at a lower side than a driven coupling 2220 and a driving coupling 2320.

In the present embodiment, a mutually-engaged structure is formed in a direction of gravity through the engaging groove and the lever engaging portions at one side and the other side of the sweep module 2000, respectively.

Unlike in the present embodiment, only the first lever 2510 in which the driven coupler is not disposed may form the mutually-engaged structure downward with the base 32. The other side of the sweep module 2000 may be supported by the body 30 through the driving coupling 2320 and the driven coupling 2220 described later.

In the present embodiment, the sweep module 2000 may be detachably coupled to the body 30 by the engaged groove at one side, the one-side lever engaging portion, the engaged groove at the other side, and the other-side lever engaging portion, the driving coupling 2320, and the driven coupling 2220.

The second side cover 2180 may include a second side cover body 2183, a through hole 2181 or 2182, a hook portion 2184, a fastening portion 2186, and an opening surface 2185. The second side cover body 2183 may be in close contact with the other side (a right side in the present embodiment) of the housing assembly 2001. The through hole 2181 or 2182 may be disposed to penetrate the second side cover body 2183. The hook portion 2184 may protrude from the second side cover body 2183 toward the housing assembly 2001 and may be hooked-coupled with the housing assembly 2001. The fastening portion 2186 may couple the second side cover body 2183 and the housing assembly 2001 by a fastening member (not shown). In order to transmit driving force of the driving unit 2300 to the agitator 2200, the driving unit 2300 may penetrate the opening surface 2185.

The opening surface 2185 may be disposed in the left-right direction. A first coupler 2310 of the driving unit 2300, which will be described later, may be inserted through the opening surface 2185.

The sweep module 2000 may include a second guide 2547, a second guide hole 2528, a third position fixing portion 2527, and a fourth position fixing portion 2546. The second guide 2547 may protrude to the second lever 2520 at the other side (a right side in the present embodiment) of the dust housing 2100 and mutually interfere with the second lever 2520 to guide a movement direction of the second lever 2520. The second guide hole 2528 may be formed at the second lever 2520, and the second guide 2547 may be inserted to the second guide hole 2528 so that the movement of the second guide 2547 is guided. The second position fixing portion 2527 may be disposed at the second lever 2520 and may be inserted into the other end of the second-lever elastic member 2542. The fourth position fixing portion 2546 may be disposed at the dust housing 2100 and one end of the second-lever elastic member 2542 may be inserted into the fourth position fixing portion 2546.

The agitator 2200 may include an agitator assembly 2210, a driven coupling 2220, a coupling elastic member 2230, a coupling stopper 2270. The agitator assembly 2210 may sweep a foreign material on a floor into the collection space 2102 through rotation. The driven coupling 2220 may receive rotational force from the driving unit 2300 and may be relatively movably disposed between the driving unit 2300 and the agitator assembly 2210. The coupling elastic member 2230 may be disposed between the agitator assembly 2210 and the driven coupling 2220, provide elastic force to the driven coupling 2220, and press the driven coupling 2220 toward the driving unit 2300. The coupling stopper 2270 may penetrate the driven coupling 2220 and be coupled to the agitator assembly 2210, and form a mutually-engaged structure with the driven coupling 2220 in a left-right direction to prevent the driven coupling 2220 from being separated.

The agitator assembly 2210 may include an agitator body 2240, a shaft member 2201, a collection member 2250, and a bearing 2600. The agitator body 2240 may be disposed at the collection space 2102, and be rotated by receiving the rotational force of the driving unit 2300. The shaft members 2201 may be disposed at one side and the other side of the agitator body 2240, respectively, provide a rotation center of the agitator body 2240, and be rotatably supported by the dust housing 2100. The collection member 2250 may be installed on an outer circumferential surface of the agitator body 2240 and sweep a foreign material into the collection space 2102. The bearing 2600 may provide rolling friction to the shaft member 2201.

In the present embodiment, the driven coupling 2220 may be assembled detachably with a lever (the second lever 2520 in the present embodiment) and the shaft member 2201 and may move together with the lever. In the present embodiment, the coupling of the driven coupling 2220 with the driving unit 2300 may be released by operation force of a user applied to the second lever 2520.

The driven coupling 2220 may move toward the shaft member 2201, and the coupling with the driving unit 2300 may be released. The driven coupling 2220 may relatively move in a horizontal direction between the agitator assembly 2210 and the driving unit 2300.

The agitator body 2240 may be disposed in the left-right direction. The agitator body 2240 may be disposed at an inside of the collection space 2102.

The collection member 2250 may be formed along an outer circumferential surface of the agitator body 2240. The collection member 2250 may protrude radially outward from the outer circumferential surface of the agitator body 2240. The collection member 2250 may rotate together with the agitator body 2240 when the agitator body 2240 rotates. The collection member 2250 may penetrate the collection opening surface 2101 and be in contact with the floor. The collection member 2250 may be composed of a plurality of brushes.

When the agitator assembly 2210 rotates, the collection member 2250 may be contact with the foreign material on the floor and move the foreign material into the collection space 2102.

Figure 18:
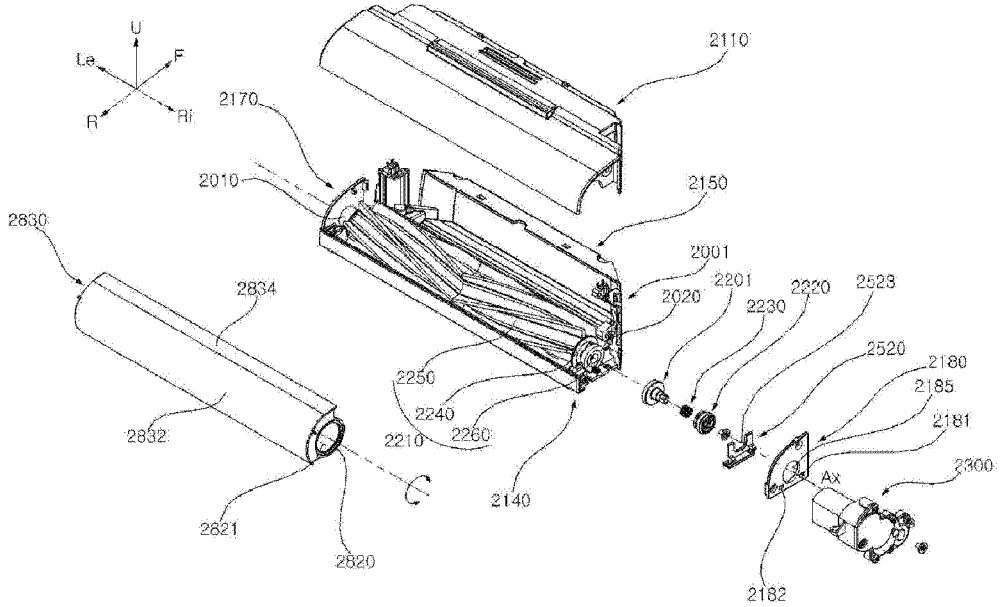
FIG. 18 is a partially exploded perspective view of the sweep module showing a coupled structure of an agitator shown in FIG. 5.
Figure 19:
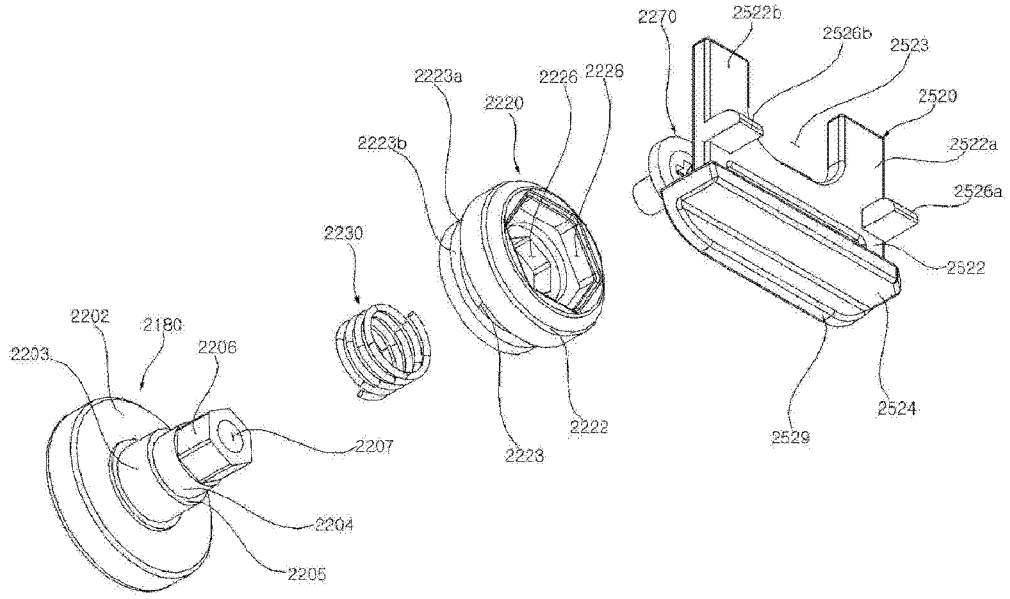
FIG. 19 is an exploded perspective view showing an assembled structure of a driven coupling shown in FIG. 18.
Figure 20:
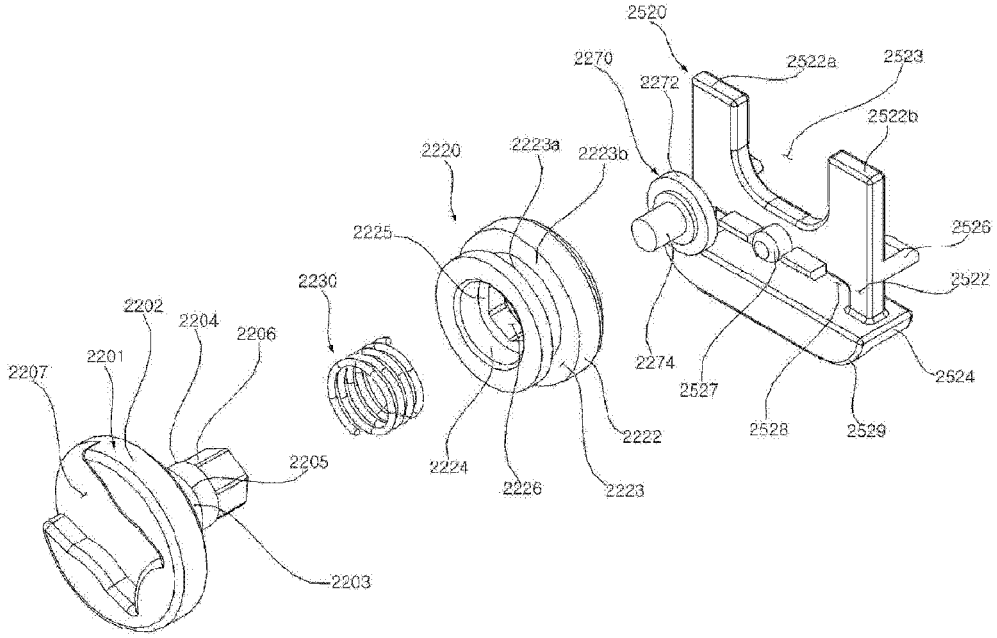
FIG. 20 is a perspective view viewed from a left side of FIG. 19.
Figure 21:
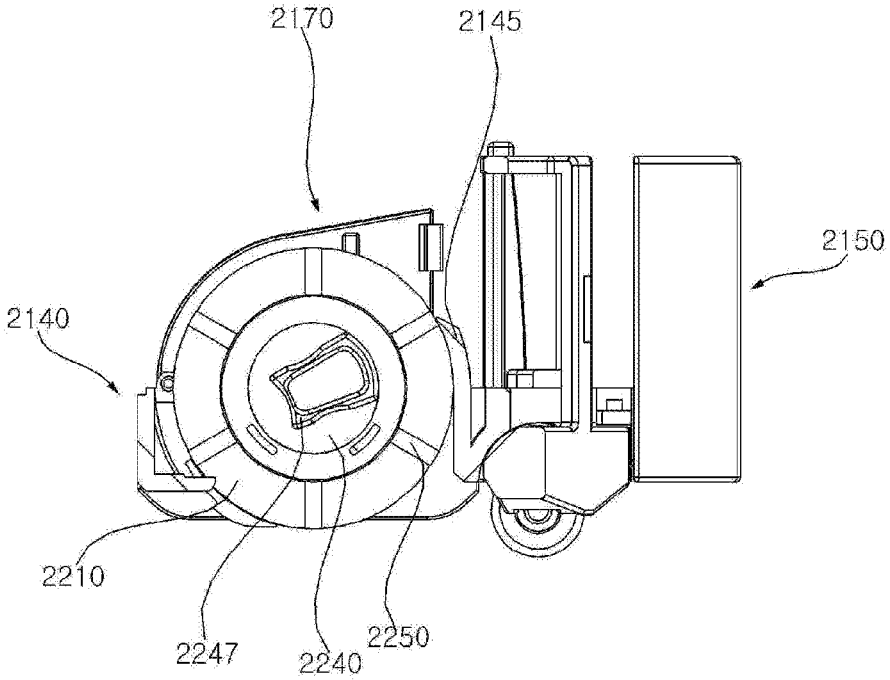
FIG. 21 is a right cross-sectional view showing the agitator of FIG. 18.
Figure 22:
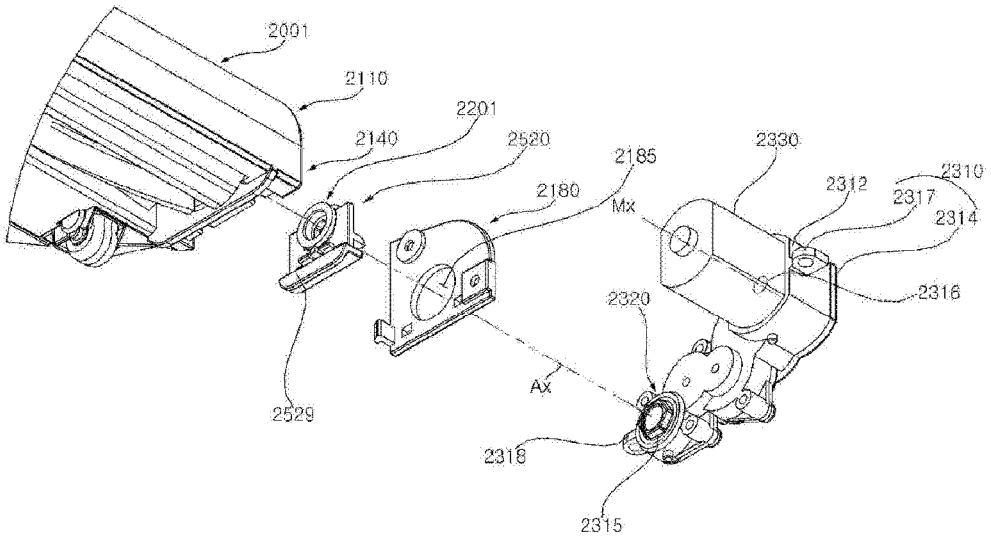
FIG. 22 is an exploded perspective view of a driving unit viewed from a left side of FIG. 18.

FIG. 18 is a partially exploded perspective view of the sweep module showing a coupled structure of the agitator shown in FIG. 5. FIG. 19 is an exploded perspective view showing an assembled structure of the driven coupling shown in FIG. 18. FIG. 20 is a perspective view viewed from a left side of FIG. 18. FIG. 21 is a right cross-sectional view showing the agitator of FIG. 18. FIG. is an exploded perspective view of the driving unit viewed from a left side of FIG. 18.

Referring to FIG. 16 to FIG. 18, the shaft members 2201 may be disposed at one side and the other side of the agitator body 2240, respectively. The shaft member 2201 may form a center of rotation of the agitator assembly 2210.

The shaft member 2201 may be disposed in the left-right direction. The shaft member 2201 may penetrate left and right sides of the collection space 2102.

In the present embodiment, the shaft member 2201 may penetrates the left wall 2011 and the right wall 2012 of the dust housing 2100. The shaft member 2201 may be integral with the agitator body 2240.

In the present embodiment, the shaft member 2201 may be separably or detachably assembled with the agitator body 2240. The shaft member 2201 and the agitator body 2240 may form a mutually-engaged structure in a rotation direction of the agitator 2200, but may be separated in a rotation-axis direction (a left-right direction in the present embodiment) of the agitator 2200.

The agitator assembly 2210 and the shaft member 2201 may be detachably assembled, Therefore, only the agitator assembly 2210 can be replaced. That is, the agitator assembly 2210 may be separated from the dust housing 2100 in a state that each shaft member 2201 is assembled to the dust housing 2100.

Since the agitator 2200 is a consumable element, the agitator 2200 may be periodically replaced. Through a coupling structure of the shaft member 2201 and the agitator body 2240, only the agitator body 2240 may be separated from the dust housing 2100 without an entire separation of the agitator 2200. The shaft member 2201 and the agitator body 2240 maintain a state of a mutually-engaged structure.

The shaft member 2201 may include a rotating shaft body 2202, a shaft portion 2203, and a coupling guide 2204. The rotating shaft body 2202 may be mutually coupled to the agitator body 2240. The shaft portion 2203 may protrudes from the rotating shaft body 2202 toward the driving unit 2300, provide a rotation center of the agitator 2200, and be coupled with the bearing 2260. The coupling guide 2204 may protrude from the shaft portion 2203 toward the driving portion 2300 more and penetrate the driven coupling 2220. The coupling stopper 2270 may be coupled to the coupling guide 2204.

The rotating shaft body 2202 may have a disk shape. The shaft portion 2203 may protrude from the rotating shaft body 2202 toward the driving portion 2300.

A diameter or a size of the shaft portion 2203 may be smaller than a diameter of the rotating shaft body 2202.

The shaft portion 2203 may have a cylindrical shape. An outer surface of the shaft portion 2203 may be inserted into the bearing 2260. The shaft portion 2203 may be inserted into and supported by the bearing 2260.

The coupling guide 2204 may further protrude from the shaft portion 2203 toward the driving portion 2300 more. Curvature centers of the coupling guide 2204 and the shaft portion 2203 may be located on the same rotation center.

A diameter of the coupling guide 2204 may be smaller than a diameter of the shaft portion 2203, and a first step 2205 may be formed between the coupling guide 2204 and the shaft portion 2203 due to a diameter difference.

One end of the coupling elastic member 2230 may be supported by the first step 2205.

The coupling guide 2204 may further include a through portion 2206 penetrating the driven coupling 2220. A coupling stopper 2270 may be fixed to the through portion 2206.

The driven coupling 2220 may move in the left-right direction along the coupling guide 2204. Since the driven coupling 2220 is elastically supported by the coupling elastic member 2230, the driven coupling 2220 may be kept in close contact with the driving unit 2300 when external force is not applied.

In the present embodiment, the coupling guide 2204 may have a circular columnar shape, and the through portion 2206 may have a polygonal column shape (a hexagonal column shape in the present embodiment).

The through portion 2206 may be inserted into the driven coupling 2220 and form a mutually-engaged structure in a rotation direction of the agitator 2200.

On the other hand, the shaft member 2201 is provided with a key groove 2207 for a mutually-engaged structure with the agitator body 2240. The key groove 2207 may be disposed on an opposite side of the shaft portion 2203 based on or with respect to the rotating shaft body 2202. The key groove 2207 may be disposed at a side facing the agitator body 2240. The key groove 2207 may have a shape of an atypical polygon. The key groove 2207 may be open in a radial direction of the rotation axis.

A key 2247, which is inserted into the key groove 2207, may be formed at the agitator body 2240. The key 2247 may protrude toward the shaft member 2201 or the driven coupling 2220.

The driven coupling 2220 may include a coupling body 2222, a first guide groove 2224, a second guide groove 2226, a second step 2225, and a power transmission groove 2228. The coupling body 2222 may be coupled with a lever (the second lever 2520 in the present embodiment). The first guide groove 2224 may be formed at one side (a left side in the present embodiment) of the coupling body 2222 to have a concave shape, The coupling guide 2204 may be inserted and the coupling elastic member 2230 may be inserted into the first guide groove 2224. The second guide groove 2226 may communicate with the first guide groove 2224, and penetrate the coupling body 2222. The through portion 2206 may be inserted to the second guide groove 2226. The second step 2225 may be disposed between the first guide groove 2224 and the second guide groove 2226, and the first step 2205 may be supported by the second step 2225. The power transmission groove 2228 may be formed at the other side (the right side in the present embodiment) of the coupling body 2222 to have a concave shape. The driving coupling 2320 coupled to the driving unit 2300 may be detachably inserted into the power transmission groove 2228.

A diameter of the first guide groove 2224 may be larger than a diameter of the coupling elastic member 2230. A diameter of the coupling elastic member 2230 may be larger than a diameter of the coupling guide 2204 and smaller than a diameter of the first guide groove 2224.

The first guide groove 2224 may have a circular hollow shape.

The second guide groove 2226 may have a shape corresponding to a shape of the through portion 2206. In the present embodiment, the second guide groove 2226 has a hollow shape which side surface has a hexagonal shape.

The coupling body 2222 may be provided with a groove 2223, which has a concave shape to an inside in a radial direction at an outer side surface. A diameter of the groove 2223 may be smaller than an outer surface diameter of the coupling body 2222.

A coupling groove 2523 may be formed at the upper lever body 2522 of the second lever 2520. The coupling groove 2523 may be inserted into the groove 2223 and thus may be engaged with the driven coupling 2220.

The groove 2223 may be perpendicular to a rotation center of the agitator 2200.

The second lever 2520 may be coupled to or separated from the driven coupling 2220 in the up-down direction and form a mutually-engaged structure with the driven coupling 2220 in the left-right direction.

The second lever 2520 may further include a first extension portion 2522*a* and a second extension portion 2522*b* extending from an upper side of the upper lever body 2522. The coupling groove 2523 may be formed between the first extension portion 2522*a* and the second extension portions 2522*b*.

The first extension portion 2522*a* and the second extension portion 2522*b* are structures for more robust assembly with the driven coupling 2220. The first extension portion 2522*a* and the second extension portion 2522*b* may be contact with one side surface 2223*a* and the other side surface 2223*b* of the groove 2223.

The coupling stopper 2270 may penetrate the driven coupling 2220 and may be fastened to the through portion 2206. The driven coupling 2220 may move in the left-right direction between the coupling stopper 2270 and the shaft member 2201.

A head 2702 of the coupling stopper 2270 may interfere with the power transmission groove 2228 of the driven coupling 2220 and prevent the driven coupling 2220 from being separated to a right side. A coupling portion 2274 of the coupling stopper 2270 may be inserted into and fastened to a fastening groove 2207 of the through portion 2206.

The driving coupling 2320 may be inserted into the power transmission groove 2228 and may be coupled to the power transmission groove 2228 to transmit rotational force. The power transmission groove 2228 may have any of various shapes or forms. In the present embodiment, the power transmission groove 2228 may have a hexagonal groove when viewed from a lateral side.

A diameter of the power transmission groove 2228 may be larger than a diameter of the second guide groove 2226. The power transmission groove 2228 and the second guide groove 2226 may communicate with each other. The first guide groove 2224 may be disposed at one side of the second guide groove 2226 to be communicated with the second guide groove 2226 and the power transmission groove 2228 may be disposed at the other side of the second guide groove 2226 to be communicated with the second guide groove 2226.

The power transmission groove 2228 may be open toward the other side, and the first guide groove 2224 may be open toward one side.

When the driven coupling 2220 is coupled to the upper lever body 2522, the power transmission groove 2228 may be positioned at the other side of the upper lever body 2522 and the first guide groove 2224 may be positioned at one side of the upper lever body 2522.

The second lever 2520 may form a mutually-engaged structure with the driven coupling 2220 with respect to a direction perpendicular to the shaft member 2201. In addition, the lever engaging portion 2526 of the second lever 2520 may form a mutually-engaged structure with the base 32.

When the driving coupling 2320 and the driven coupling 2220 are mutually coupled, the driven coupler 2220 may protrude to an outside of the dust housing 2100. Specifically, the driven coupling 2220 may penetrate the opening surface 2185 of the second side cover 2180 and may protrude to an outside than the second side cover 218.

By the operation of the second lever 2520, the driven coupling 2220 may be moved to the same position with the opening surface 2185 or to an inside than the opening surface 2185. When the driven coupling 2220 is moved to the same portion with the opening surface 2185 or to the inside than the opening surface 2185, the driven coupling 2220 can be prevented from being interfered with the base 32 and the dust housing 2100 can be easily separated.

Therefore, a moving distance of the second lever 2520 may be greater than a thickness of the driven coupler 2220 and the driving coupling 2320 in a coupled state.

When the second lever 2520 is pressed toward the agitator 2200, the second lever 2520 moves toward the agitator 2200. Thus, the mutually-engaged structure of the lever engaging portion 2526 and the base 32 is released and the dust housing 2100 is in a state being able to be separated from the base 32.

In addition, when the second lever 2520 is pressed toward the agitator 2200, the coupling elastic member 2230 may be compressed and the driven coupling 2220 may move toward the agitator 2200.

When the driven coupling 2220 moves toward the agitator 2200 by the second lever 2520, the driven coupling 2220 and the driving unit 2300 are physically separated and the dust housing 2100 is in a state being able to be separated from the base 32.

Since the sweep module 2000 according to the present embodiment has a structure in which the agitator 2200 is installed on the inside of the sweep module 2000, the dust housing 2100 should be physically separated from the driving unit 2300 when the dust housing 2100 is separated from the base 32.

The movement of the second lever 2520 not only releases the coupling of the dust housing 2100 and the base 32 but also releases the coupling of the driven coupling 2220 and the driving unit 2300 at the same time.

In this instance, since the second lever 2520 is hidden or shield inside the dust housing 2100 and only the operation unit 2529 is exposed to the outside, a coupling structure of the driven coupling 2220 is not exposed to the outside. In particular, since the second side cover 2180 shields or blocks most of the second lever 2520, damage to the second lever 2520 due to external impact can be minimized.

Even if the second lever 2520 is repeatedly used, the second lever 2520 moves only at an inside of the dust housing 2100 and thus separation or damage of the second lever 2520 can be minimized.

In addition, since the side covers 2170 and 2180 shield or cover the levers 2510 and 2520 inside the dust housing 2100, an intrusion of an external foreign material or the like to portions where the levers 2510 and 2520 can be minimized. Accordingly, reliability according to the operation can be ensured.

Then, when the operation force applied to the second lever 2520 is removed, the driven coupling 2220 moves toward the other side by elastic force of the coupling elastic member 2230.

In this instance, since the shaft member 2201 penetrates through the driven coupling 2220 and the coupling stopper 2270 is coupled to the shaft member 2201, the driven coupling 2220 can be prevented from being separated from the shaft member 2201. That is, the driven coupling 2220 may move along an axis direction of the shaft member 2201, but may be prevented from being separated from the shaft member 2201 by the coupling stopper 2270.

The driving unit 2300 may include a drive housing 2310, a sweep motor 2330, a power transmission assembly 2340, and a driving coupling 2320. The drive housing 2310 may be assembled with the body 30. The sweep motor 2330 may be assembled with a drive housing 2310. The power transmission assembly 2340 may be disposed at an inside of the drive housing 2310 and be assembled with the sweep motor 2330 to receive rotational force. The driving coupling 2320 may be coupled to the power transmission assembly 2340 and be selectively engaged with the driven coupling 2220.

Since the agitator 2200 is disposed inside the sweep module 2000 and the sweep motor 2330 is disposed inside the body 30, the driving coupling 2320 and the driven coupling 2220 transmitting the rotational force to the agitator 2200 may have selectively-detachable structure. If the driving coupling 2320 and the driven coupling 2220 are not detachable, the dust housing 2100 cannot be separated from the body 30.

The drive housing 2310 may be fixed to the body 30. The drive housing 2310 is fixed to the base 32 in the present embodiment. The drive housing 2310 is a structure for installing the power transmission assembly 2340 and the sweep motor 2330.

The drive housing 2310 may have any of various shapes of forms. In the present embodiment, the drive housing 2310 shields or covers the power transmission assembly 2340 therein, and exposes only the sweep motor 2330 and the driving coupling 2320 to the outside.

The drive housing 2310 may include a first drive housing 2312 and a second drive housing 2314, a coupling-installed portion 2315, and a hole 2316. The first drive housing 2312 and the second drive housing 2314 may form an outer shape. The coupling-installed portion 2315 may be disposed at one of the first drive housing 2312 and the second drive housing 2314, and the driving coupling 2320 may be disposed at the coupling-installed portion 2315. The hole 2316 may be disposed at one of the first drive housing 2312 and the second drive housing 2314, and a motor shaft of the sweep motor 2330 may penetrate the hole 2316.

The power transmission assembly 2340 may be disposed between the first drive housing 2312 and the second drive housing 2314.

In the present embodiment, the first drive housing 2312 is disposed at one side (toward the agitator 2200), and the second drive housing 2314 is disposed at the other side (at an outside).

In the present embodiment, the coupling-installed portion 2315 is disposed at the first drive housing 2312. The driving coupling 2320 is disposed at the coupling-installed portion 2315 and is connected to the power transmission assembly 2340. The driving coupling 2320 may rotate in a state that the driving coupling is installed on the coupling installation unit 2315.

The driving coupling 2320 has a shape corresponding to a shape of the power transmission groove 2228 of the driven coupling 2220. In the present embodiment, the driving coupling 2320 has a hexagonal shape when viewed from a lateral side. The driving coupling 2320 may be selectively engaged with the driven coupling 2220 through the opening surface 2185 of the second side cover 2180.

The driving coupling 2320 may protrude toward the second side cover 2180 than one side (a left side) of the first drive housing 2312 in a state that the driving coupling 2320 is assembled to the drive housing 2310.

A rotation center of the driving coupling 2320 is disposed at the left-right direction and may match the rotation center of the agitator 2200.

In the present embodiment, the first drive housing 2312 may have a space formed therein, and the power transmission assembly 2340 may be rotatably installed in the space. The second drive housing 2314 may have a shape or a form of a cover covering the first drive housing 2312.

The drive housing 2310 may further include a first fastening portion 2317 and a second fastening portion 2318. The first fastening portion 2317 and the second fastening portion 2318 may be disposed at the first drive housing 2312. The first fastening portion 2317 and the second fastening portion 2318 may be formed so that a fastening member is installed on the first fastening portion 2317 or the second fastening portion 2318 in an up-down direction.

A motor axis of the sweep motor 2330 may be disposed in the left-right direction. The sweep motor 2330 may be disposed at one side or the other side of the drive housing 2310.

The sweep motor 2330 may be disposed toward an inside of the body 30 based on or with respect to the drive housing 2310. A volume of the body 30 may be minimized by arranging the sweep motor 2330 at a side of the agitator 2200.

In the present embodiment, a motor axis direction Mx of the sweep motor 2330 and a rotation axis Ax of the agitator 2200 may be parallel. In the present embodiment, a rotation center of the agitator 2200, a rotation center of the shaft member 2201, a center of the driven coupling 2220, and a center of the driving coupling 2320 are located on a line of the rotation axis Ax of the agitator 2200.

In the present embodiment, the sweep motor 2330 is positioned at an upper side than the dust housing 2100. The sweep motor 2330 is positioned at a rear side than the dust housing 2100. The sweep motor 2330 is positioned at an upper side than the installation space 325 and the storage housing 326 of the base 32.

The power transmission assembly 2340 may include a plurality of gears. A number and a shape of gears included in the power transmission assembly 2340 may be various depending on a number of revolutions and transmitted torque.

Figure 23:
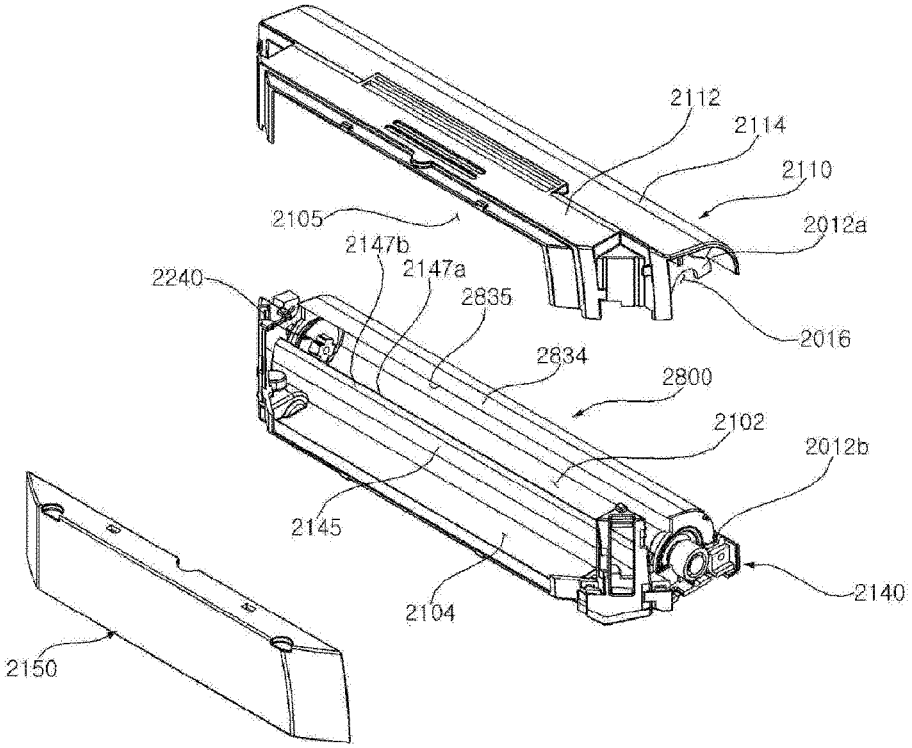
FIG. 23 is an exploded perspective view of a dust housing shown in FIG. 5.
Figure 24:
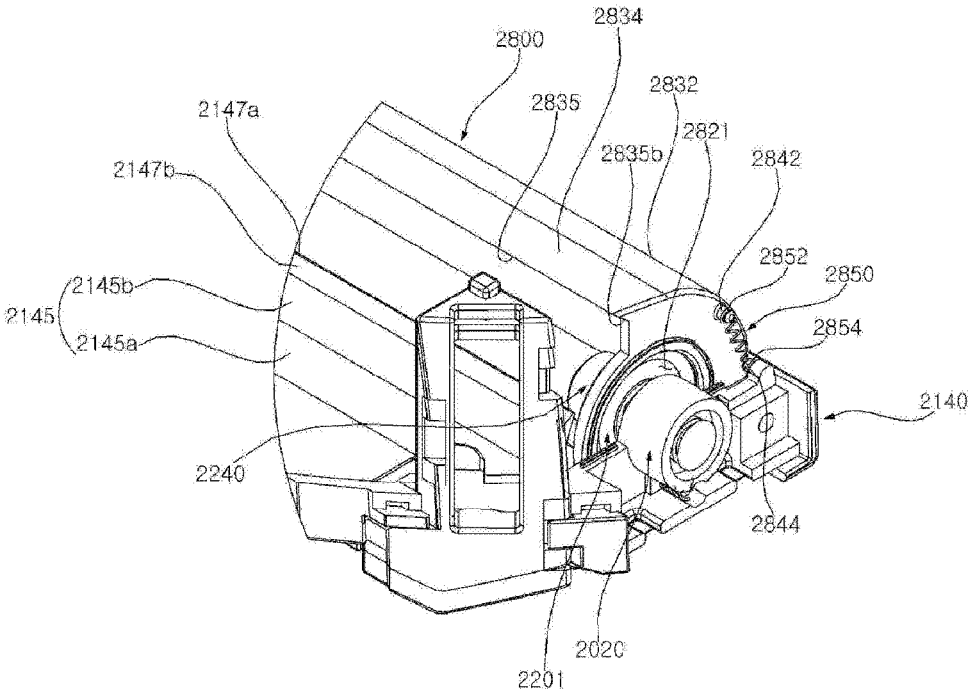
FIG. 24 is an enlarged view of a dustpan shown in FIG. 23.
Figure 25:
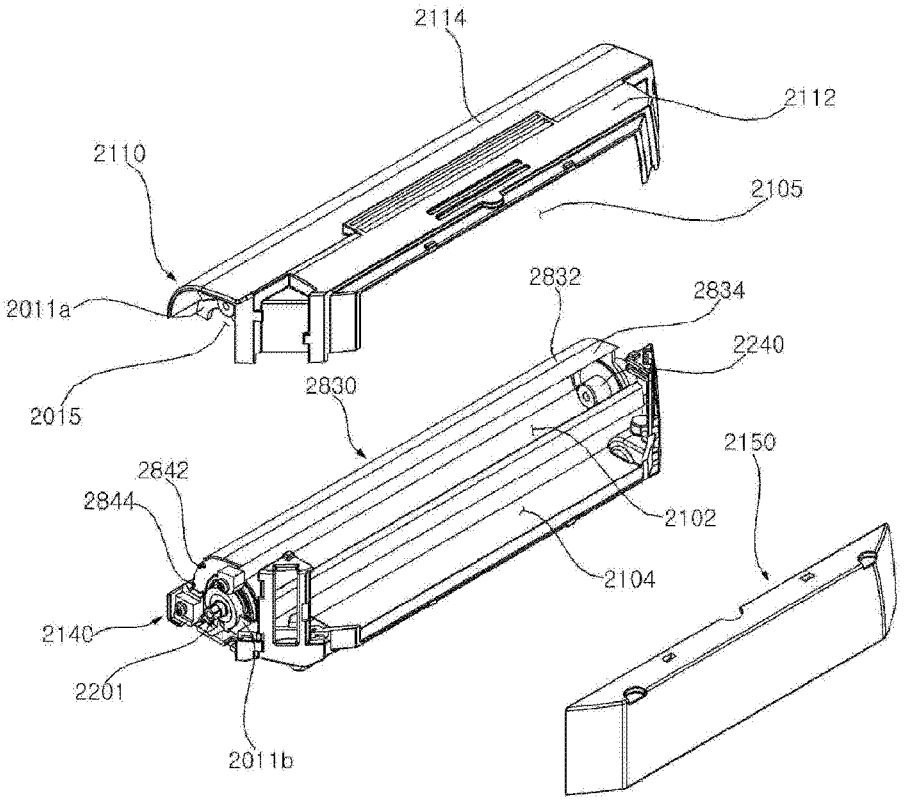
FIG. 25 is an exploded perspective view of the dust housing shown in FIG. 5 when viewed from an upper left side.
Figure 26:
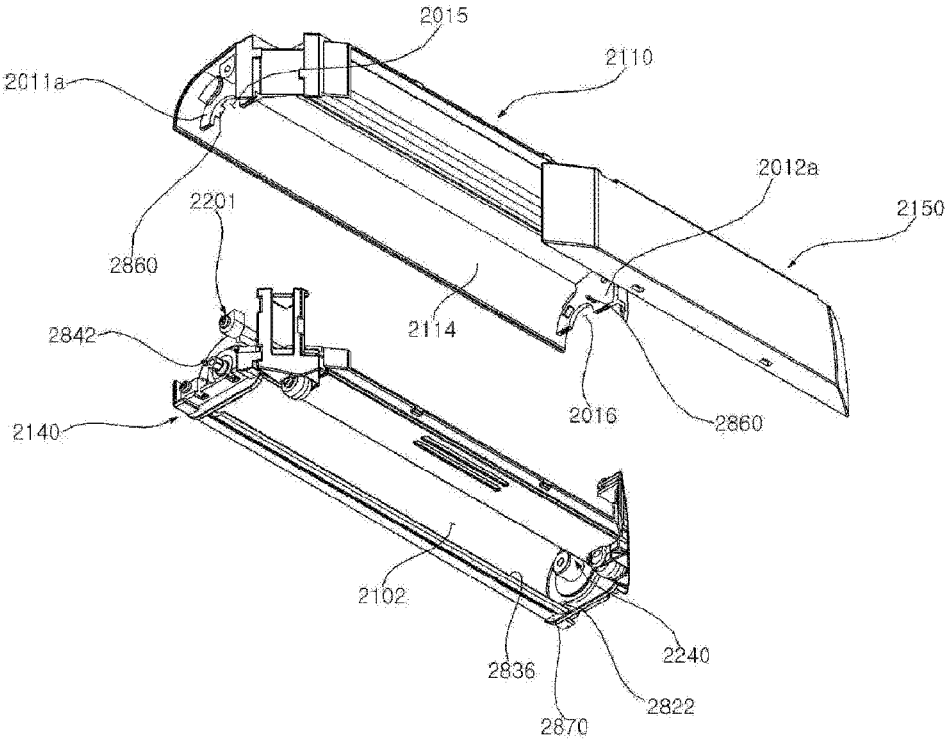
FIG. 26 is an exploded perspective view of the dust housing shown in FIG. 5 when viewed from a lower left side.
Figure 27:
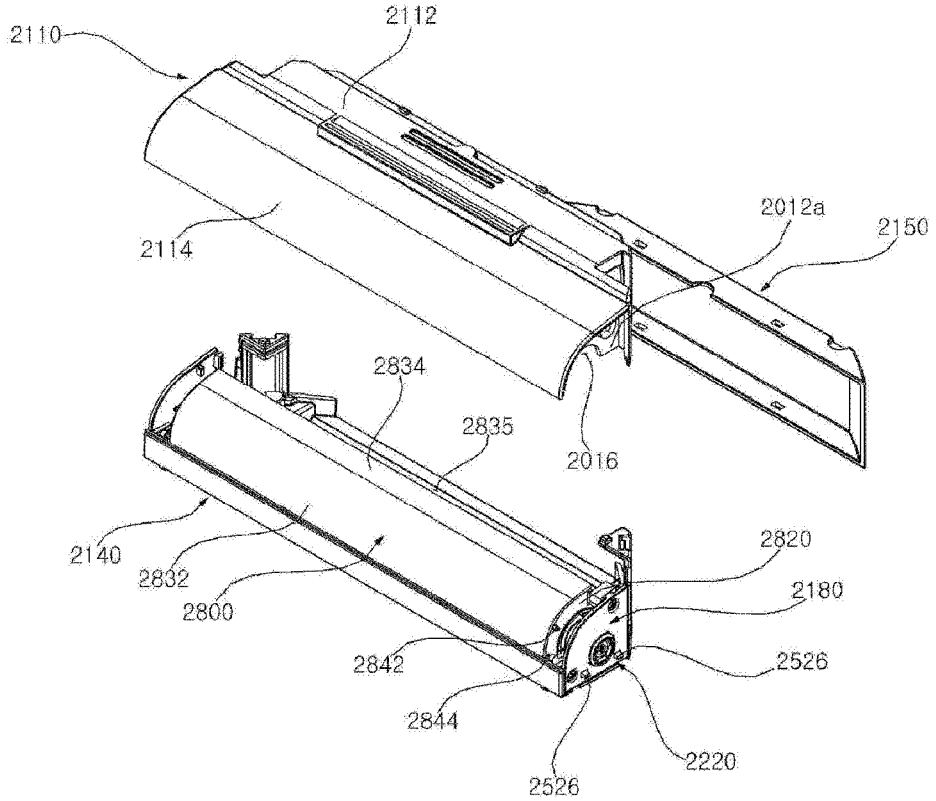
FIG. 27 is an exploded perspective view of the dust housing shown in FIG. 5 when viewed from a rear side.
Figure 28:
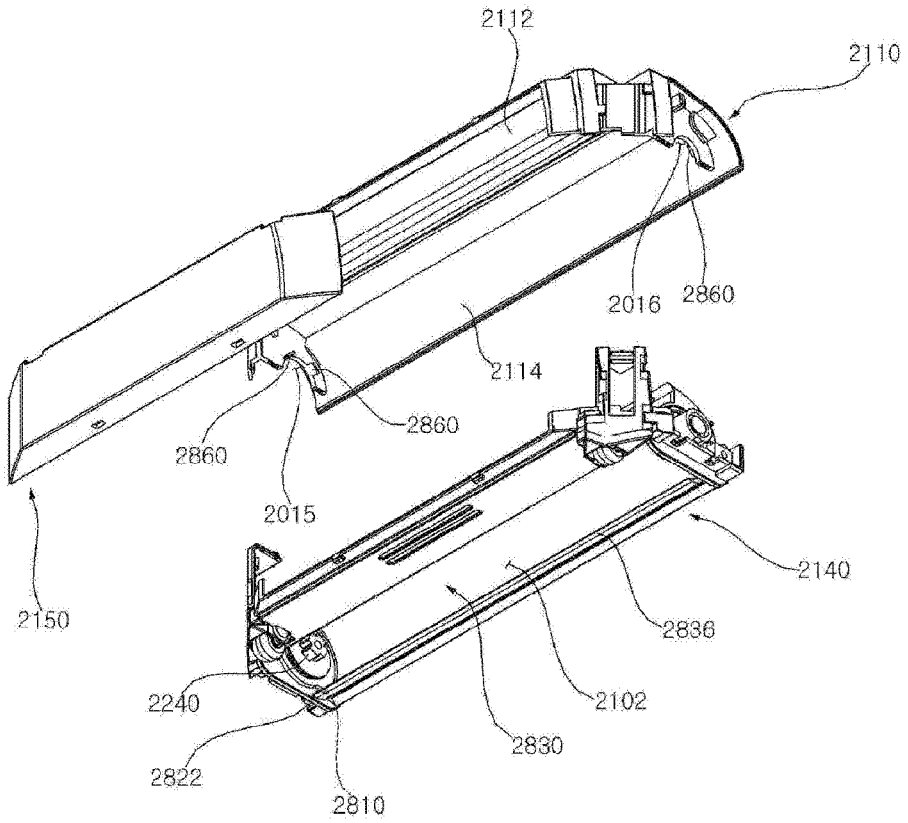
FIG. 28 is an exploded perspective view of the dust housing shown in FIG. 5 when viewed from a lower front side.
Figure 29:
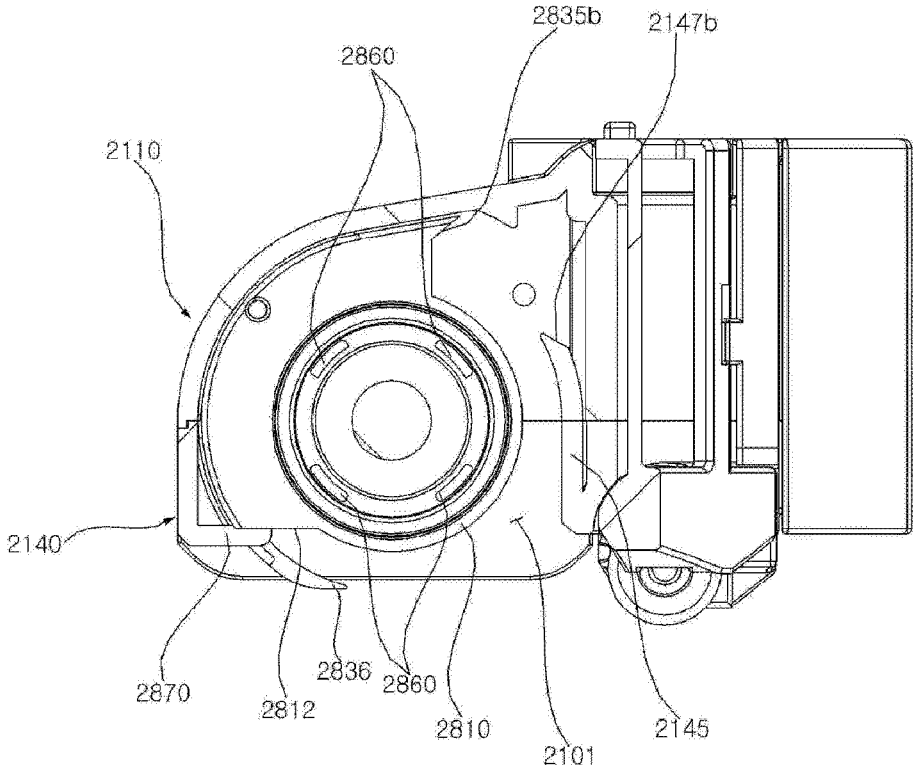
FIG. 29 is a cross-sectional view showing a dustpan stopper shown in FIG. 7.
Figure 30:
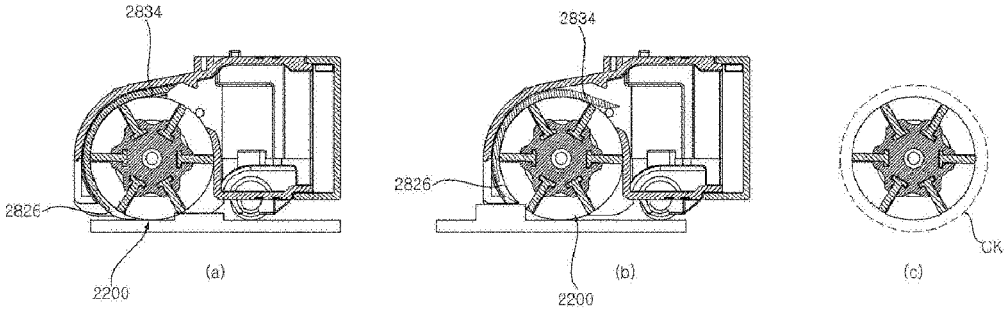
FIG. 30 is an exemplary operation view of the dustpan according to the first embodiment of the present disclosure.

FIG. 23 is an exploded perspective view of the dust housing shown in FIG. 5. FIG. 24 is an enlarged view of a dustpan shown in FIG. 23. FIG. 25 is an exploded perspective view of the dust housing shown in FIG. 5 when viewed from an upper left side. FIG. 26 is an exploded perspective view of the dust housing shown in FIG. 5 when viewed from a lower left side. FIG. 27 is an exploded perspective view of the dust housing shown in FIG. 5 when viewed from a rear side. FIG. 28 is an exploded perspective view of the dust housing shown in FIG. 5 when viewed from a lower front side. FIG. 29 is a cross-sectional view showing a dustpan stopper shown in FIG. 7. FIG. 30 is an exemplary operation view of the dustpan according to the first embodiment of the present disclosure.

A dustpan will be described in more detail with reference to FIG. 7, FIG. 18, and FIG. 23 to FIG. 28.

The sweep module 2000 may further a dustpan 2800. The dustpan 2800 may be disposed at an inside of the collection space 2102 and may be disposed between the dust housing 2100 and the agitator 2200. A lower end of the dustpan 2800 may protrude to a floor through the collection opening surface 2101.

The sweep module 2000 may further include a pan elastic member 2850 that is assembled to the dust housing 2100 and the dustpan 2800 and provides elastic force to the dustpan 2800.

By the elastic force of the pan elastic member 2850, a lower end of the dustpan 2800 may penetrate through the collection opening surface 2101 and maintain a protruding state at a lower side.

In the present embodiment, the pan elastic member 2850 is disposed to press the lower end of the dustpan to the floor. Unlike the present embodiment, the lower end of the dustpan may be in contact with the floor only by a weight or a self-load of the dustpan.

The dustpan 2800 may be installed to be rotatable relative to the agitator 2200. The dustpan 2800 may be rotatably installed with the dust housing 2100. The dustpan 2800 may surround the agitator 2200.

The dustpan 2800 may include a guide pan housing 2830, a first side pan housing 2810, and a second side pan housing 2820. The guide pan housing 2830 may surround a part of an outer surface of the agitator 2200. The first side pan housing 2810 may be disposed at one side (a left side in the present embodiment) of the guide pan housing 2830 and cover one side of the agitator 2200. The second side pan housing 2820 may be disposed at the other side (a right side in the present embodiment) of the guide pan housing 2830 and cover the other side of the agitator 2200.

The guide pan housing 2830 may be disposed to surround a part of an outer circumferential surface of the agitator 2200 having a cylindrical shape. A portion of the agitator 2200 surrounded by the guide pan housing 2830 may be associated with a rotational direction of the agitator 2200.

In the present embodiment, the agitator 2200 is rotated from a front side to a rear side based on or with respect to a driving direction or a traveling direction of the cleaner. When viewed from a right surface based on the driving direction or the traveling direction of the cleaner, the agitator 2200 may rotate in a clockwise direction.

Since the agitator 2200 rotates from the front side to the rear side, it assists in driving or moving the cleaner. Since the agitator 2200 rotates from the front side to the rear side, a foreign material on a floor may be moved to a rear side by the agitator 2200.

The dustpan 2800 sweeps up the foreign material moved to the rear side of the agitator 2200.

Thus, the guide pan housing 2830 may be formed to surround a back surface of the agitator 2200. The guide pan housing 2830 may be in close contact with an outer surface of the agitator 2200. Since the guide pan housing 2830 is in close contact with an outer circumferential surface of the agitator 2200, a foreign material may be confined between the agitator 2200 and the guide pan housing 2830. The foreign material confined between the agitator 2200 and the guide pan housing 2830 may be rotated together with the agitator 2200 and moved to the storage space 2104.

The guide pan housing 2830 may be preferably formed to surround the agitator 2200 from a bottom to an upper portion in order to easily transfer the foreign material.

The guide pan housing 2830 may have a curved surface, and a curvature center of the guide pan housing 2830 may be disposed at an inside of the agitator 2200.

The curvature center of the guide pan housing 2830 may be disposed at the rotation axis Ax of the agitator 2200. A radius of curvature of an inner surface of the guide pan housing 2830 may be the same as a radius of curvature of an outer surface of the agitator 2200.

The guide pan housing 2830 may include a curved portion 2832, a flat portion 2834, and a dust guard 2836. The curved portion 2832 may be formed to surround a rear side of the outer circumferential surface of the agitator 2200. The flat portion 2832 may extend from an upper end of the curved portion 2832 and formed of a flat surface. The dust guard 2836 may be coupled to a lower end of the curved portion 2832 and be in contact with a floor.

The dust guard 2836 may be coupled to the lower end of the curved portion 2832. The dust guard 2836 may be preferably formed of a material having elasticity. By the elasticity of the dust guard 2836, a contact property with a floor can be enhanced, thereby preventing the foreign material from escaping between the dust guard 2836 and the floor.

During operation of the cleaner, the dust guard 2836 may protrude to a lower side than the collection opening surface 2101. The dust guard 2836 may protrude to a lower side than a lower surface of the lower housing 2140.

A lower end of the dust guard 2836 may be positioned at a lower side than the collection opening surface 2101. When the dust guard 2836 and an obstacle of or on a floor collide or interfere with each other, the dust guard 2836 may be accommodated into the collection space 2102.

The dust guard 2836 may collide with a hard structure on or of the floor while the cleaner drives or travels. The dust guard 2836 formed of an elastic material may cushion or relieve an impact during the collision.

When the guide pan housing collides with the structure on or of the floor, the guide pan housing 2830 may cushion or relieve an impact through rotation. This structure will be described later.

A length of the guide pan housing 2830 in the left-right direction may be longer than the agitator 2200. The first side pan housing 2810 and the second side pan housing 2820 may cover a left side and a right side of the agitator 2200, respectively.

Since the first side pan housing 2810 and the second side pan housing 2820 have the same structure and bisymmetrical or laterally symmetrical to each other, the second side pan housing 2820 will be described as an example.

A first through hole (not shown) through which the agitator 2200 penetrates may be formed at the first side pan housing 2810. A second through hole 2821 through which the agitator 2200 penetrates may be formed at the second side pan housing 2820.

In the present embodiment, the agitator body 2240 and the shaft member 2201 may installed to penetrate through the through hole 2821.

The side pan housings 2810 and 2820 may be rotated around or with respect to the rotation axis Ax of the shaft member 2201. The side pan housings 2810 and 2820 may be supported by a component or an element (e.g., the agitator body, the shaft member, or so on) of the agitator 2200 to be rotated in the front-rear direction.

However, since the agitator 2200 is configured to rotate, when the side pan housings 2810 and 2820 are supported by the agitator 2200, the side pan housings 2810 and 2820 may also rotate. Therefore, in the present embodiment, the side pan housings 2810 and 2820 are assembled with the dust housing 2100 and rotated in the front-rear direction in a state assembled with the dust housing 2100.

The side pan housings 2810 and 2820 are rotatably assembled with the left wall 2011 and the right wall 2012 of the dust housing 2100, respectively.

The left wall 2011 may include an upper left wall 2011*a* disposed at the upper housing 2110 and a lower left wall 2011*b* formed at the lower housing 21040. The right wall 2012 may include an upper right side wall 2012*a* disposed at the upper housing 2110 and a lower right side wall 2012*b* formed at the lower housing 2140.

The first journal 2010 may be disposed between the upper left wall 2011*a* and the lower left wall 2011*b*, and the second journal 2020 may be disposed between the upper right wall 2012*a* and the lower right wall 2012*b*.

A first journal groove 2015 by which the first journal 2010 is supported may be formed between the upper left wall 2011*a* and the lower left wall 2011*b*. The first through hole may be positioned at an inside with respect to the first journal 2010. The first through hole may be disposed at an inside of the first journal groove 2015 and communicate with the first journal groove 2015.

A second journal groove 2016 by which the second journal 2020 is supported may be formed between the upper right wall 2012*a* and the lower right wall 2012*b*. The second through hole 2821 may be positioned at an inside with respect to the second journal 2020. The second through hole may be disposed at an inside of the second journal groove 2016 and communicate with the second journal groove 2016.

A plurality of pan guides 2860 inserted into an inside of the first through hole and guiding rotation of the first side pan housing 2810 may be disposed at an inner side surface of the upper left wall 2011*a* and the lower left wall 2011*b*.

Similarly, a plurality of pan guides 2860 inserted into an inside of the second through hole and guiding rotation of the second side pan housing 2820 may be disposed at an inner side surface of the upper right wall 2012*a* and the lower right wall 2012*b*.

The pan guides 2860 at the left wall may protrude toward the right wall, and the pan guides 2860 at the right wall may protrude toward the left wall.

The plurality of pan guides 2860 may be disposed within the same radius with respect to the rotation axis Ax and have the same radius of curvature. The pan guides 2860 may be inserted into the through hole 2821 from outsides of the side pan housings 2810 and 2820.

The pan guide 2860 disposed at the left side may support the first side pan housing 2810, and the pan guide 2860 disposed at the right side may support the second side pan housing 2820.

The guide pan housing 2830 may rotate around or with respect to a rotation axis Ax in a state supported by the pan guide 2860.

One end of the pan elastic member 2850 may be fixed to the dustpan 2800 and the other end of the pan elastic member 2860 may be fixed to the dust housing 2100. The pan elastic member 2850 may return the dustpan 2800 to an initial position through elastic force.

The pan elastic member 2850 may be disposed at any of various positions. In the present embodiment, the pan elastic member 2850 may be coupled to a side pan housing and a dust housing 2100 (a lower housing in the present embodiment).

The pan elastic members 2850 may be disposed at the left side and the right side of the dustpan 2800, respectively, and provide elastic force in the same direction at both sides of the dustpan 2800. The pan elastic member 2850 may include a first pan elastic member and a second pan elastic member.

A first pan fixing portion 2842 to which one end of the pan elastic member 2850 is fixed may be disposed at the second side pan housing 2820, and a second pan fixing portion 2844 to which the other end of the pan elastic member 2850 is fixed may be disposed at the lower housing 2140 (specifically, a right wall).

The first pan fixing portion 2842 may be disposed at an upper side than or higher than the second pan fixing portion 2844. The first pan fixing portion 2842 may be disposed at a rear side than the second pan fixing portion 2844.

The pan elastic member 2850 may provide elastic force so that a lower end of the dustpan 2800 is rotated to a lower side.

In the present embodiment, since the dustpan 2800 is disposed at a rear side of the agitator 2200, the first pan fixing portion 2842 and the second pan fixing portion 2844 may be disposed at a rear side than the rotation axis Ax.

When the agitator 2200 rotates, force to move the body 30 to a front direction may be provided through friction force by the agitator 2200 and the floor.

The foreign material on the floor is swept and moved to the rear side by the rotation of the agitator 2200, and the dustpan 2800 sweeps up the moved foreign material.

Referring to FIG. 30, when the dustpan 2800 collides with a structure or an obstacle on or of the floor while the cleaner drives, the dustpan 2800 may be rotated around or with respect to the rotation axis Ax.

In the collision, the dust guard 2836 of the dustpan 2800 is rotated about or with respect to the rotation axis Ax and may be accommodated into the collection space 2102.

That is, when the dust guard 2836 and an obstacle collide with each other, the dust guard 2836 is rotated to an upper side to reduce an impact and may be accommodated into the collection space 2102, thereby avoiding interference with the obstacle.

In the collision, the first pan fixing portion 2842 is rotated from a rear side to a front side to expand the pan elastic member 2850. When the interference due to the obstacle is removed, the dustpan 2800 is rotated to an original position by the elastic force of the pan elastic member 2850.

When the dustpan 2800 collides with an obstacle, the dustpan 2800 may be rotated by mutual interference with the obstacle. Thus, a front side of the body 30 can be prevented from being lifted away from the floor and a height of the body 30 can be kept constant.

The dustpan 2800 rotates independently with the agitator 2200. In this instance, the phrase that the dustpan 2800 rotates may mean that the dustpan 2800 moves as a circular movement at a part of a circular orbit surrounding the agitator 2200.

The dustpan 2800 may be disposed at an area of 40% to 70% of an arbitrary circle surrounding the outer circumference of the agitator 2200. Specifically, most of the area of 40% to 70% of the arbitrary circle where the dustpan 2800 is disposed may be disposed at a rear side than the rotation axis of the agitator 2200. Therefore, the foreign material moved by the agitator 2200 may be guided to the storage space positioned at a front side than the agitator 2200.

The dustpan 2800 may move within an arc having a center angle of 180 degrees to 220 degrees at an arbitrary circular orbit (an orbit of an arbitrary circle) CK surrounding the outer circumference of the agitator 2200 and may have a smaller length than the arc. Most of the arc may be disposed at a rear side than the rotation axis of the agitator 2200. Specifically, the dustpan 2800 may form an arc having a central angle of 170 degrees to 200 degrees at the arbitrary circular orbit surrounding the outer circumference of the agitator 2200.

Meanwhile, referring to FIG. 29, in order to prevent the dustpan 2800 from being excessively rotated to the floor, a dustpan stopper 2870 may be formed at least one of the dustpan 2800 and the dust housing 2100.

The dustpan stopper 2870 is disposed within a rotation radius of the dustpan 2800. In the present embodiment, the dustpan stopper 2870 is disposed within rotation radii of the side pan housings 2810 and 2820.

Specifically, the dustpan stopper 2870 may be disposed at the lower housing 2140, and lower ends 2812 and 2822 of the side pan housing 2820 may be mutually interfered with the dustpan stopper 2870.

The dustpan stopper 2870 may be disposed at a lower side than the lower end 2822 of the side pan housing 2820 and may support the lower end 2822.

Since the lower end 2822 is supported by the dustpan stopper 2870, excessive rotation of the dustpan 2800 can be prevented even when the elastic force of the pan elastic member 2850 is provided.

In the present embodiment, the dustpan stopper 2870 is disposed at the collection opening surface 2101.

The dustpan stopper 2870 may be disposed at a side portion of the guide pan housing 2830.

On the other hand, when the dustpan 2800 is rotated due to interference with an obstacle, an upper end 2835 of the flat portion 2834 may be in contact with an upper end 2147*a* of the partition 2145.

When the upper end 2835 of the flat portion 2834 and the upper end 2147*a* of the partition 2145 are in contact with each other, the rotation of the dustpan 2800 is restricted.

In particular, in order to prevent a collision when the flat portion 2834 and the partition 2145 are in contact with each other, a lower surface of the upper end 2835 may be formed as an inclined surface 2835*b* and the inclined surface 2835*b* may be in contact with and supported by an inclined surface 2147*b* of the partition 2145.

In this instance, the inclined surface 2835*b* of the upper end 2835 may be positioned at an upper side than the inclined surface 2147*b* of the partition 2145.

That is, when the dustpan 2800 is rotated, the flat portion 2834 is supported by the partition 2145 and the rotation of the dustpan 2800 is restricted, thereby preventing damage to the pan elastic member 2850.

In addition, since the flat portion 2834 is supported by the partition 2145, the dustpan 2800 can be prevented from being excessively rotated and the dustpan 2800 can be prevented from not returning to an initial position due to the excessive rotation.

When bottoms of the pair of spin mops 41*a* and 41*b* provided to be symmetrical to each other with respect to the central longitudinal line Po are parallel to a horizontal plane, a robot cleaner may not stably drive and a driving control may be difficult. Therefore, according to the present disclosure, each spin mop 41 is inclined downward toward an outside front side. Hereinafter, an inclination and a motion of a spin mop 41 will be described.

The central longitudinal line Po means a line parallel to a front-rear direction and passing through a geometric center Tc of a body. The central longitudinal line Po may be defined as a line passing through the geometric center Tc of the body while being perpendicular to an imaginary line connecting a central axis of the left spin mop and a central axis of the right spin mop.

Figure 31:
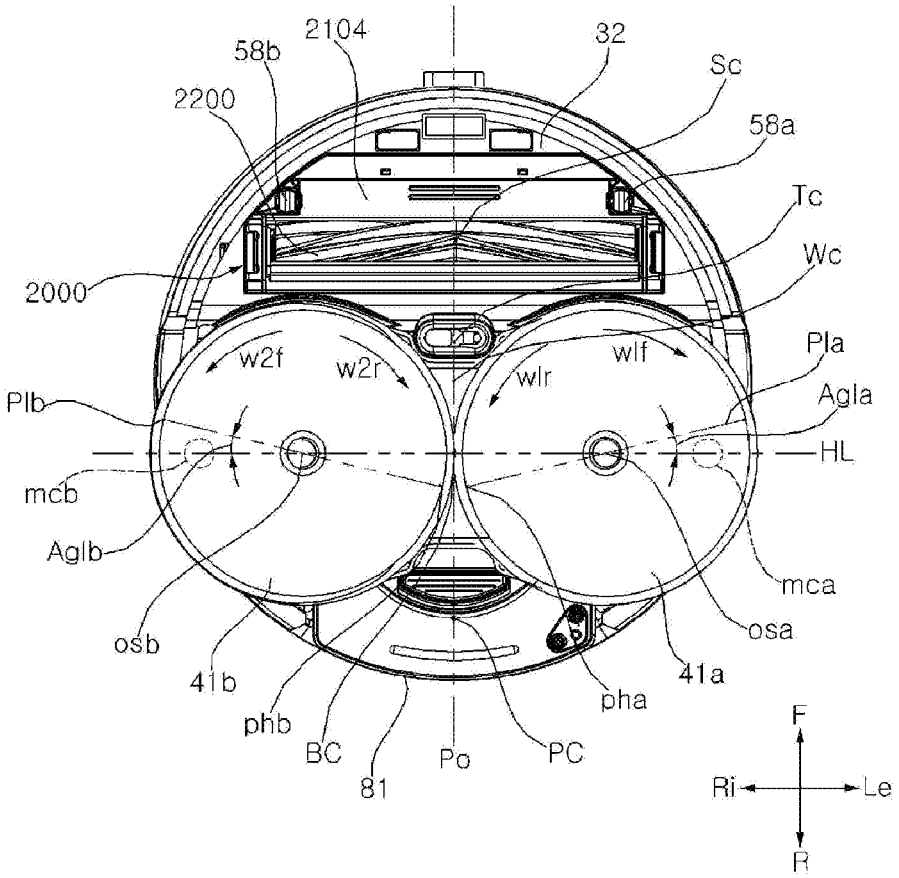
FIG. 31 is a bottom view showing the cleaner of FIG. for explaining a weight center and lowest ends of spin mops according to the present disclosure.

Referring to FIG. 31, a point where the spin rotation axis Osa of the left spin mop 41*a* and a lower surface of the left spin mop 41*a* cross is shown, and a point where the spin rotation axis Osb of the right spin mop 41*b* and a lower surface of the right spin mop 41*b* intersect is shown. When viewed from a lower side, among rotational directions of the left spin mop 41*a*, a clockwise direction is defined as a first normal direction w1*f* and a counterclockwise direction is defined as a first reverse direction w1*r*. When viewed from a lower side, among rotational directions of the right spin mop 41*b*, a clockwise direction is defined as a second normal direction w2*f* and a counterclockwise direction is defined as a second reverse direction w2*r*. In addition, when viewed from a lower side, 'an acute angle between an inclined direction of a lower surface of the left spin mop 41*a* and a left-right direction axis' and 'an acute angle between an inclined direction of a lower surface of the right spin mop 41*a* and a left-right direction axis' are defined as inclination-direction angles Ag1*a* and Ag1*b*, respectively. The inclination-direction angle Ag1*a* of the left spin mop 41*a* and the inclination-direction angle Ag1*b* of the right spin mop 41*b* may be the same. Further, referring to FIG. 6, 'an angle between a lower surface I of the left spin mop 41*a* and an imaginary horizontal surface H' and 'an angle between a lower surface I of the right spin mop 41*b* and an imaginary horizontal surface H' are defined as inclination angles Ag2*a* and Ag2*b*.

A right end of the left spin mop 41*a* and a left end of the right spin mop 41*b* may be in contact with each other or adjacent or close to each other. Therefore, an area where mopping or wiping is not performed between the left spin mop 41*a* and the right spin mop 41*b* can be reduced.

When the left spin mop 41*a* rotates, a point Pla that receives the greatest friction force from a floor or a ground at a lower surface of the left spin mop 41*a* may be positioned at a left side of a rotation center Osa of the left spin mop 41*a*. Among the lower surface of the left spin mop 41*a*, a greater load may be transmitted to the floor or the ground at the point Pla than the other point. Thus, the greatest friction force may be generated at the point Pla. In the present embodiment, the point Pla is disposed at a left front side of the rotation center Osa. In another embodiment, the point Pla may be disposed at an exact left side or at a left rear side based on the rotation center Osa.

When the right spin mop 41*b* rotates, a point Plb that receives the greatest friction force from a floor or a ground at a lower surface of the right spin mop 41*b* may be positioned at a right side of a rotation center Osb of the right spin mop 41*b*. Among the lower surface of the right spin mop 41*b*, a greater load may be transmitted to the floor or the ground at the point Plb than the other point. Thus, the greatest friction force may be generated at the point Plb. In the present embodiment, the point Plb is disposed at a right front side of the rotation center Osb. In another embodiment, the point Pla may be disposed at an exact right side or at a right rear side based on the rotation center Osb.

The lower surface of the left spin mop 41*a* and the lower surface of the right spin mop 41*b* may be inclined, respectively. The inclination angle Ag2*a* of the left spin mop 41*a* and the inclination angle Ag2*b* of the right spin mop 41*b* may be an acute angle. The inclination angles Ag2*a* and Ag2*b* may be small so that points having the greatest friction force are positioned at the points Pla and Plb and entire portions of lower surfaces of the mop portions 411 are in contact with or touch the floor according to rotational motion of the left spin mop 41*a* and the right spin mop 41*b*.

The lower surface of the left spin mop 41*a* forms a downward slope as a whole in a left direction. The lower surface of the right spin mop 41*b* forms a downward slope as a whole in a right direction. Referring to FIG. 6, the lowest point Pla at the lower surface of the left spin mop 41*a* is positioned at a left side portion. The highest point Pha at the lower surface of the left spin mop 41*a* is positioned at a right side portion. The lowest point Plb at the lower surface of the right spin mop 41*b* is positioned at a right side portion. The highest point Phb at the lower surface of the right spin mop 41*b* is positioned at a right side portion.

According to the embodiment, an inclination-direction angles Ag1*a* and Ag1*b* may be 0 degrees. Further, according to the embodiment, when viewed from a lower side, a lower surface of the left spin mop 41*a* may be inclined to have an inclined-direction angle Ag1*a* in a clockwise direction with respect to a left-right direction axis, and a lower surface of the right spin mop 41*b* may be inclined to have an inclined-direction angle Ag1*b* in a counterclockwise direction with respect to the left-right direction axis. In the present embodiment, when viewed from a lower side, a lower surface of the left spin mop 41*a* is inclined to have an inclined-direction angle Ag1*a* in a counterclockwise direction with respect to the left-right direction axis, and a lower surface of the right spin mop 41*b* is inclined to have an inclined-direction angle Ag1*b* in a clockwise direction with respect to the left-right direction axis.

The movement of the cleaner 1 is achieved by friction force with the floor or the ground generated by the mop module 40.

The mop module 40 may generate 'a forward-moving friction force' for moving the body 30 in a front direction, or 'a rearward-moving friction force' for moving the body 30 in a rear direction. The mop module 40 may generate 'a left-moment friction force' to rotate or turn the body 30 left, or 'a right-moment friction force' to rotate or turn the body 30 right. The mop module 40 may generate friction force in which any one of the forward-moving friction force and the rearward-moving friction force is combined with any one of the left moment friction force and the right moment friction force.

In order for the mop module 40 to generate the forward-moving friction force, the left spin mop 41*a* may rotate at a predetermined rpm R1 in the first normal direction w1*f* and the right spin mop 41*b* may rotate at the predetermined rpm R1 in the second normal direction w2*f*.

In order for the mop module 40 to generate the rearward-moving friction force, the left spin mop 41*a* may rotate at a predetermined rpm R2 in the first reverse direction w1*r* and the right spin mop 41*b* may rotate at the predetermined rpm R2 in the second reverse direction w2*r*.

In order for the mop module 40 to generate the right-moment friction force, the left spin mop 41*a* may rotate at a predetermined rpm R3 in the first normal direction w1*f*, and the right spin mop 41*b* may rotate in the second reverse direction w2*r*, may stop without rotation, or may rotate at a rpm R4 smaller the rpm R3 in the second normal direction w2*f*.

In order for the mop module 40 to generate the left-moment friction force, the right spin mop 41*b* may rotate at a predetermined rpm R5 in the second normal direction w2*f*, and the left spin mop 40*b* may rotate in the first reverse direction w1*r*, may stop without rotation, or may rotate at a rpm R6 smaller the rpm R5 in the second normal direction w1*f*.

Hereinafter, an arrangement of components or elements for improving friction force of the spin mops 41 arranged at a left side and a right side, improving stability in a left-right direction and a front-rear direction, and achieving stable driving regardless of a water level in a water tank 81.

Figure 32:
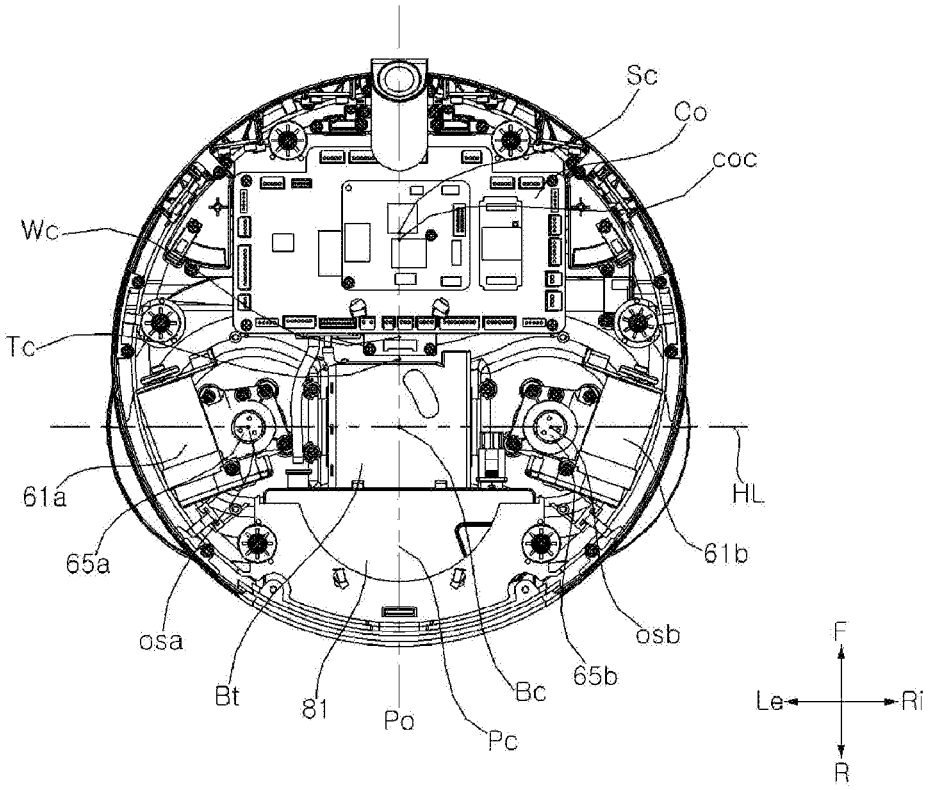
FIG. 32 is a plan view of the cleaner of FIG. 1 viewed from an upper side in a state that a case is removed from the body for explaining the weight center according to the present disclosure.

Referring to FIGS. 31 and 32, so as to increase the friction force by a spin mop 41 and limit occurrence of eccentricity in one direction when the mobile robot rotates, a mop motor 61 and a battery Bt that are relatively heavy may be disposed on an upper portion of a spin mop 41.

Specifically, a left-mop motor 61*a* may be disposed on a left spin mop 41*a* (at an upper side of the left spin mop 41*a*), and a right-mop motor 61*b* may be disposed on a right spin mop 41*b* (at an upper side of the right spin mop 41*b*). That is, at least a part of the left-mop motor 61*a* may be vertically overlapped with the left spin mop 41*a*. Preferably, an entire portion of the left-mop motor 61*a* may be vertically overlapped with the left spin mop 41*a*. At least a part of the right-mop motor 61*b* may be vertically overlapped with the right spin mop 41*b*. Preferably, an entire portion of the right-mop motor 61*b* may be vertically overlapped with the right spin mop 41*b*.

More specifically, the left-mop motor 61*a* and the right-mop motor 61*b* may be vertically overlapped with an imaginary central horizontal line HL connecting a spin rotation axis Osa of the left spin mop 41*a* and a spin rotation axis Osb of the right spin mop 41*b*. Preferably, a weight center (a center of gravity) MCa of the left-mop motor 61*a* and a weight center (a center of gravity) MCb of the right-mop motor 61*b* may be vertically overlapped with the imaginary central horizontal line HL connecting the spin rotation axis Osa of the left spin mop 41*a* and the spin rotation axis Osb of the right spin mop 41*b*. Alternatively, a geometric center of the left-mop motor 61*a* and a geometric center of the right-mop motor 61*b* may be vertically overlapped with the imaginary central horizontal line HL connecting the spin rotation axis Osa of the left spin mop 41*a* and the spin rotation axis Osb of the right spin mop 41*b*. The left-mop motor 61*a* and the right-mop motor 61*b* may be symmetrical with respect to a central longitudinal line Po.

Since the weight center MCa of the left-mop motor 61*a* and the weight center MCb of the right-mop motor 61*b* do not deviate from the spin mop 41, and the left-mop motor 61*a* and the right-mop motor 61*b* are symmetrical to each other. Accordingly, the friction force of the spin mop 41 can be enhanced and running performance and a left-right balance can be maintained.

Hereinafter, the spin rotation axis Osa of the left spin mop 41*a* is referred to as a left spin rotation axis Osa, and the spin rotation axis Osb of the right spin mop 41*b* is referred to as a right spin rotation axis Osb.

The water tank 81 is disposed at a rear side than the central horizontal line HL, and an amount of water in the water tank 81 is variable. In order to maintain a stable front-rear balance regardless of a water level of the water tank 81, the left-mop motor 61*a* may be deviated to a left side from the left spin rotation axis Osa. The left-mop motor 61*a* may be deviated to a left front side from the left spin rotation axis Osa. Preferably, the geometric center of the left-mop motor 61*a* or the weight center MCa of the left-mop motor 61*a* may be deviated to the left side from the left spin rotation axis Osa, or the geometric center of the left-mop motor 61*a* or the weight center MCa of the left-mop motor 61*a* may be deviated to the left front side from the left spin rotation axis Osa.

The right-mop motor 61*b* may be deviated to a right direction from the right spin rotation axis Osb. The right-mop motor 61*b* may be deviated to a right front side from the right spin rotation axis Osb. Preferably, the geometric center of the right-mop motor 61*b* or the weight center MCb of the right-mop motor 61*b* may be deviated to the right side from the right spin rotation axis Osb, or the geometric center of the right-mop motor 61*b* or the weight center MCb of the right-mop motor 61*b* may be deviated to the right front side from the right spin rotation axis Osb.

Since the left-mop motor 61*a* and the right-mop motor 61*b* apply pressure at a position deviated from an outer front side from a center of each spin mop 41, pressure is concentrated on the outer front side of each spin mop 41. Therefore, running performance can be improved by the rotational force of the spin mop 41.

The left spin rotation axis Osa and the right spin rotation axis Osb are disposed at a rear side than the center of the body 30. The central horizontal line HL may be disposed at a rear side of the geometric center Tc of the body 30 and a weight center (a center of gravity) WC of the mobile robot. The left spin rotation axis Osa and the right spin rotation axis Osb are spaced apart at the same distance from the central longitudinal line Po.

A left driving joint 65*a* may be disposed on the left spin mop 41*a* (at an upper side of the left spin mop 41*a*), and a right driving joint 65*a* may be disposed on the right spin mop 41*b* (at an upper side of the right spin mop 41*b*).

In the present embodiment, one battery Bt may be installed. At least a part of the battery Bt may be disposed on the left spin mop 41*a* and the right spin mop 41*b* (at upper sides of the left spin mop 41*a* and the right spin mop 41*b*). The battery Bt that is relative heavy is disposed on the spin mop 41 (at the supper side of the spin mop 41) to improve friction force by the spin mop 41 and reduce eccentricity caused by the rotation of the mobile robot.

Specifically, a part of a left portion of the battery Bt may be vertically overlapped with the left spin mop 41*a*, and a part of a right portion of the battery Bt may be vertically overlapped with the right spin mop 41*b*. The battery Bt may be vertically overlapped with the central horizontal line HL and may be vertically overlapped with the central longitudinal line Po.

More specifically, a weight center (a center of gravity) BC of the battery Bt or a geometric center of the battery Bt may be disposed at the central longitudinal line Po and may be disposed at the central horizontal line HL. The weight center BC of the battery Bt or the geometric center of the battery Bt may be disposed at the central longitudinal line Po, may be disposed at a front side of the central horizontal line HL, and may be disposed at a rear side of the geometric center Tc of the body 30.

The weight center of the battery Bt or the geometric center of the battery Bt may be disposed at a front side than the water tank 81 or a weight center PC of the water tank 81. The weight center BC of the battery Bt or the geometric center Tc of the battery Bt may be disposed at a rear side than a weight center (a center of gravity) SC of the sweep module 2000.

One battery Bt is disposed at a middle portion between the left spin mop 41*a* and the right spin mop 41*b* and is disposed at the central horizontal line HL and the central longitudinal line Po. The battery Bt that is heavy holds centers during rotation of the spin mops 41 and provides weight on the spin mop 41, thereby improving friction force by the spin mop 41.

A height of the battery Bt (a height of a lower end of the battery Bt) may be the same as heights of the left-mop motor 61*a* and the right-mop motor 61*b* (heights of lower ends of the left-mop motor 61*a* and the right-mop motor 61*b*). Alternatively, the battery Bt may be disposed on the same plane as the left-mop motor 61*a* and the right-mop motor 61*b*. The battery Bt may be disposed between the left-mop motor 61*a* and the right-mop motor 61*b*. The battery Bt may be disposed at an empty space between the left-mop motor 61*a* and the right-mop motor 61*b*.

At least a part of the water tank 81 may be disposed on the left spin mop 41*a* and the right spin mop 41*b* (at upper sides of the left spin mob 41*a* and the right spin mop 41*b*). The water tank 81 may be disposed at a rear side than the central horizontal line HL and may be vertically overlapped with the central longitudinal line Po.

More specifically, a weight center (a center of gravity) PC of the water tank 81 or a geometric center of the water tank 81 may be disposed at the central longitudinal line Po and may be positioned at a front side than the central horizontal line HL. As another example, the weight center PC of the water tank 81 or the geometric center of the water tank 81 may be disposed at the central longitudinal line Po and may be positioned at a rear side than the central horizontal line HL. In this instance, the phrase that the weight center PC of the water tank 81 or the geometric center of the water tank 81 is disposed at the rear side than the central horizontal line HL may mean that weight center PC of the water tank 81 or the geometric center of the water tank 81 is vertically overlapped with a region deviated rearward from the central horizontal line HL. The weight center PC of the water tank 81 or the geometric center of the water tank 81 may be vertically overlapped with the body 30 without going beyond the body 30.

The weight center PC of the water tank 81 or the geometric center of the water tank 81 may be disposed at a rear side than the weight center BC of the battery Bt. The weight center of the water tank 81 PC or the geometric center of the water tank 81 may be disposed at a rear side than the weight center SC of the sweep module 2000.

A height of the water tank 81 (a height of a lower end of the water tank 81) may be the same as heights of the left-mop motor 61*a* and the right-mop motor 61*b* (heights of lower ends of the left-mop motor 61*a* and the right-mop motor 61*b*). Alternatively, the water tank 81 may be disposed on the same plane as the left-mop motor 61*a* and the right-mop motor 61*b*. The water tank 81 may be disposed at an empty space between the left-mop motor 61*a* and the right-mop motor 61*b*.

The sweep module 2000 may be disposed at a front side than the spin mops 41, the battery Bt, the water tank 81, the mop driving unit 60, the right-mop motor 61*b*, and the left-mop motor 61*a* at the body.

The weight center SC of the sweep module 2000 or a geometric center of the sweep module 2000 may be disposed at the central longitudinal line Po and may be disposed at a front side than the geometric center Tc of the body 30. When viewed from an upper side, the body 30 may have a circular shape and the base 32 may have a circular shape. The geometrical center Tc of the body 30 may means a center of the body 30 when the body 30 has the circular shape. Specifically, when viewed from an upper side, the body 30 may have a circular shape with a half-diameter error of less than 3%.

Specifically, the weight center SC of the sweep module 2000 or the geometric center of the sweep module 2000 may be disposed at the central longitudinal line Po, and may be disposed at a front side than the weight center BC of the battery Bt, the weight center PC of the water tank 81, the weight center MCa of the left-mop motor 61*a*, the weight center MCb of the right-mop motor 61*b*, and the weight center WC of the mobile robot.

Preferably, the weight center SC of the sweep module 2000 or the geometric center of the sweep module 2000 may be disposed at a front side than the central horizontal line HL and a front end of the spin mops 41.

The sweep module 2000 may include a dust housing 2100 having a storage space 2104, an agitator 2200, and a sweep motor 2330 as described above.

The agitator 2200 may be rotatably installed on the dust housing 2100 and may be disposed at a rear side than the storage space 2104. Therefore, the agitator 2200 may have an appropriate length to cover the left and right spin mops 41*a* and 41*b* and not to protrude to an outside of the body.

A rotation axis of the agitator 2200 may be parallel to the central horizontal line HL, and a center of the agitator 2200 may be positioned at the imaginary central longitudinal line Po. Therefore, a large foreign material flowing into the spin mops 41 can be effectively removed by the agitator 2200. The rotation axis of the agitator 2200 may be disposed at a front side of the geometric center Tc of the body 30. A length of the agitator 2200 may be preferably longer than a distance between the left spin rotation axis Osa and the right spin rotation axis Osb. The rotation axis of the agitator 2200 may be disposed to be adjacent to a front end of the spin mop 41.

A left caster 58*a* and a right caster 58*b* being in contact with the floor may be further provided at both ends of the dust housing 2100. The left caster 58*a* and the right caster 58*b* are rolled while being in contact with the floor and may move up and down by elastic force. The left caster 58*a* and the right caster 58*b* may support the sweep module 2000 and a part of the body. The left caster 58*a* and the right caster 58*b* may protrude from a lower end of the dust housing 2100 to a lower side.

The left caster 58*a* and the right caster 58*b* are disposed at a line parallel to the central horizontal line HL, and may be disposed at a front side than the central horizontal line HL and the agitator 2200. An imaginary line connecting the left caster 58*a* and the right caster 58*b* may be disposed at a front side than the central horizontal line HL, the agitator 2200, and the geometric center Tc of the body 30. The left caster 58*a* and the right caster 58*b* may be bisymmetrical to each other with respect to the central longitudinal line Po. The left caster 58*a* and the right caster 58*b* may be spaced apart at the same distance from the central longitudinal line Po.

The geometric center Tc of the body 30, the weight center WC of the mobile robot, the weight center SC of the sweep module 2000, and the weight center BC of the battery Bt may be disposed in an imaginary quadrangle formed by sequentially connecting the left caster 58*a*, the right caster 58*b*, the right spin rotation axis Osb, and the left spin rotation axis Osa. The battery Bt, which is relatively heavy, the left spin rotation axis Osa, and the right spin rotation axis Osb may be disposed to be adjacent to the central horizontal line HL. Then, a main load of the mobile robot may be applied to the spin mops 41 and a remaining sub-load may be the left caster 58*a* and the right caster 58*b*.

The sweep motor 2330 may disposed at the central longitudinal line Po. When the sweep motor 2330 is disposed at one side based on the central longitudinal line Po, the pump 85 is disposed at the other side based on the central longitudinal line Po (refer to FIG. 19) so that a sum weight center of the sweep motor 2330 and the pump 85 may be disposed on the central longitudinal line Po.

Therefore, the weight center of the mobile robot at a relatively front side is maintained regardless of the water level of the water tank 81 disposed at a rear side, thereby increasing friction force by the spin mop 41. Also, the weight center WC of the mobile robot is disposed to be adjacent to the geometric center Tc of the body 30 and thus stable driving can be achieved.

A weight center (a center of gravity) COC of a controller Co or a geometric center of the controller Co may be disposed at a front side than the geometric center Tc of the body 30 and the central horizontal line HL. At least a 50% or more portion of the controller Co may be vertically overlapped with the sweep module 2000.

The weight center WC of the mobile robot may be disposed at the central longitudinal line Po, may be disposed at a front side than the central horizontal line HL, may be disposed at a front side than the weight center BC of the battery Bt, and may be disposed at a front side than the weight center PC of the water tank 81, may be disposed at a rear side than the weight center SC of the sweep module 2000, and may be disposed at a rear side than the left caster 58*a* and the right caster 58*b*.

By disposing components or elements symmetrically with respect to the central longitudinal line Po or considering weights of the components or elements, the weight center WC of the mobile robot is disposed at the central longitudinal line Po. Accordingly, stability in a left-right direction can be improved.

Figure 33:
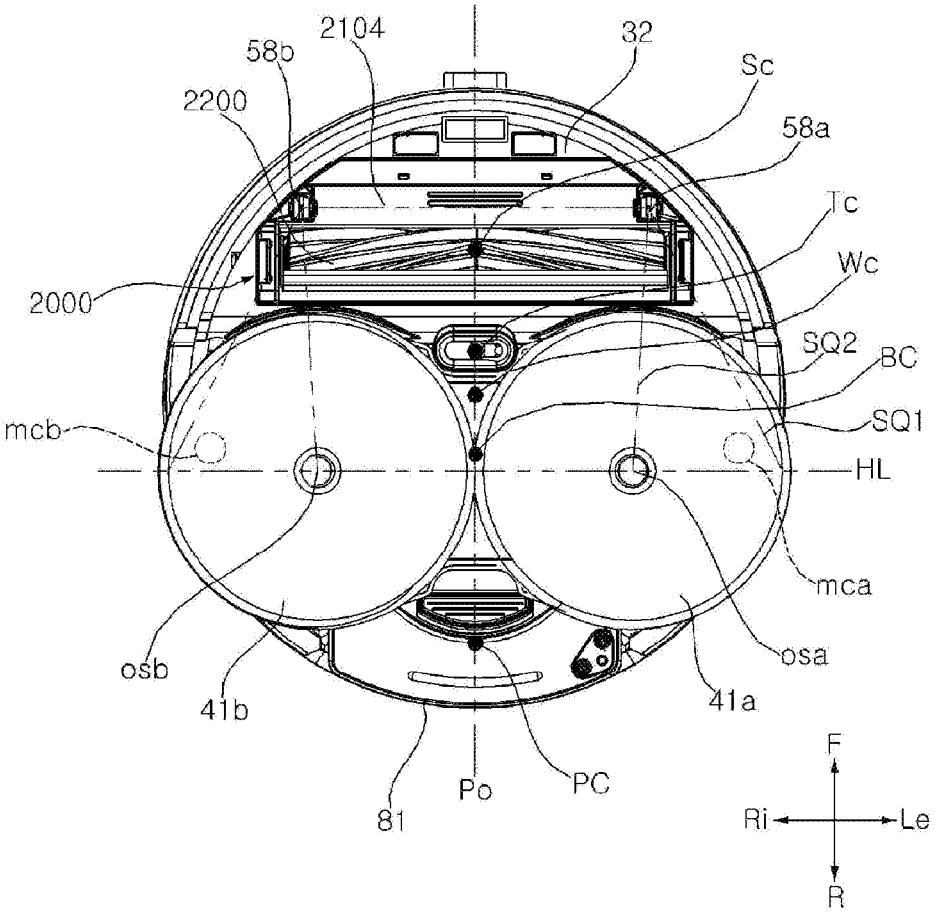
FIG. 33 is a bottom view of a cleaner according to another embodiment of the present disclosure for explaining a relationship between a weight center and other components.

FIG. 33 is a bottom view of a mobile robot according to another embodiment of the present disclosure for explaining a relationship between a weight center and other components.

Referring to FIG. 33, an embodiment will be described. A difference compared to the embodiment described with reference to FIG. 31 will be mainly described. A component or an element that is not described with respect to FIG. 33 may be regarded as the same as that of the embodiment described with reference to FIG. 31.

A weight center WC of a mobile robot and a geometric center Tc of a body 30 may be disposed in an imaginary second quadrangle SQ2 formed by sequentially connecting a left caster 58*a*, a right caster 58*b*, a right spin rotation axis Osb, and a left spin rotation axis Osa. A weight center MCa of a left-mop motor, a weight center MCb of a right-mop motor, and a weight center PC of a water tank may be disposed at an outside of the imaginary second quadrangle SQ2.

Also, a weight center WC of a mobile robot, a geometric center Tc of a body 30, a weight center BC of a battery Bt may be disposed in an imaginary second quadrangle SQ2 formed by sequentially connecting a left caster 58*a*, a right caster 58*b*, a right spin rotation axis Osb, and a left spin rotation axis Osa.

In addition, a weight center WC of a mobile robot, a geometric center Tc of a body 30, and a weight center SC of a sweep module 2000, may be disposed in an imaginary second quadrangle SQ2 formed by sequentially connecting a left caster 58*a*, a right caster 58*b*, a right spin rotation axis Osb, and a left spin rotation axis Osa.

Further, a weight center WC of a mobile robot, a geometric center Tc of a body 30, a weight center SC of a sweep module 2000, and a weight center BC of a battery Bt may be disposed in an imaginary second quadrangle SQ2 formed by sequentially connecting a left caster 58*a*, a right caster 58*b*, a right spin rotation axis Osb, and a left spin rotation axis Osa.

The weight center WC of the mobile robot, the geometric center TC of the body, the weight center SC of the sweep module 2000, and the weight center BC of the battery Bt may be disposed in the second quadrangle SQ2, and the weight center MCa of the left-mop motor and the weight center MCb of the right-mop motor may be disposed at an outside of the second quadrangle SQ2. Then, the mobile robot can apply appropriate friction force to the mop portion while stably travelling.

The weight center WC of the mobile robot and the geometric center TC of the body may be disposed in the second quadrangle SQ2, and the weight center MCa of the left-mop motor and the weight center MCb of the right-mop motor may be disposed at an outside of the second quadrangle SQ2. Then, the mobile robot can apply appropriate friction force to the mop portion while stably travelling.

The weight center WC of the mobile robot and the geometric center TC of the body may be disposed in an imaginary first quadrangle SQ1 formed by sequentially connecting the left caster 58*a*, the right caster 58*b*, the lowest point at a lower surface of the right spin mop 41*b*, and the lowest point at a lower surface of the left spin mop 41*a*. The weight center MCa of the left-mop motor and the weight center MCb of the right-mop motor may be disposed at an outside of the first quadrangle SQ1.

Firstly, according to the present disclosure, interference or impact with or from an obstacle can be minimized since a dustpan is rotated and is accommodated into a collection space positioned at inside of a dust housing when the dustpan is interfered with the obstacle on a floor.

Secondly, according to the present disclosure, a collected foreign material can be transferred to a collection space, even if a dustpan collides with an obstacle on a floor, since the dustpan is rotatable with respect to a rotation axis of the agitator.

Thirdly, according to the present disclosure, a collected foreign material can be transferred to a collection space in a state confined between a dustpan and an agitator since the dustpan is in contact with an outer circumferential surface of the agitator.

Fourthly, according to the present disclosure, a dustpan can be returned to its original position by using an elastic force of a pan elastic member since the pan elastic member connects the dustpan and a housing assembly, Fifthly, according to the present disclosure, an impact due to a contact with an obstacle can be minimized since a dust guard, which is disposed at a lower end of the dustpan and is in contact with a floor, is formed of an elastic material.

Sixthly, according to the present disclosure, excessive rotation of a dustpan can be prevented by a dustpan stopper disposed at a housing assembly and disposed within a rotational radius of the dustpan.

Seventhly, according to the present disclosure, resistance against a driving or traveling direction of a cleaner can be minimized and a dustpan disposed at a rear side of an agitator can effectively collect a foreign material moved through sweeping of the agitator since the agitator rotates from a front side to a rear side.

Eighthly, according to the present disclosure, by disposing an agitator close to a center of a body in a structure in which the agitator and a dust housing are integrated with each other, the agitator is not disturbed by an external obstacle and a width of the agitator in a left-right direction can be maximized. Thereby, a cleaning area can be maximized, a body can escape quickly when trapped in the obstacle, and the body can rotate easily.

Ninthly, according to the present disclosure, rotation of a cleaner can be easy by a circular shape of a body. A size of an area to be cleaned by a spin mop at once can be maximized and rotation of a body is not disturbed by a shape of the spin mop when the body rotates, since rotation axes of a pair of spin mops are eccentrical or deviated from a center of the body and a part of each spin mop is overlapped with the body vertically. That is, a part of each spin mop is exposed to an outside of the body. Even if the spin mop is exposed to the outside of the body, the spin mop has a circular shape, and thus, friction between an obstacle and the spin mop is reduced when the body rotates. Accordingly, the rotation of the body can be easy.

Tenthly, according to the present disclosure, a body has a circular shape and a dry-type module does not protrude to an outside of the body. Accordingly, the cleaner can be freely rotated at any position in a cleaning area. Also, an agitator can have a sufficiently large width, and thus, a cleaning range can be wide. Further, a mopping operation while collecting a foreign material having a relatively large size can be performed.

What is claimed is:

1. A mobile cleaner, comprising:

a body configured to move on a surface; and a sweep module installed on a lower portion of the body, the sweep module being configured to collect foreign material from the surface, wherein the sweep module comprises:

an agitator configured to rotate and collect the foreign material from the surface;

a storage space configured to store the foreign material collected by the agitator;

a dust housing; and a dustpan configured to direct the foreign material collected by the agitator into the dust housing, wherein the dustpan covers a portion of an outer circumferential surface of the agitator, wherein the dustpan is configured to rotate independent of the agitator, and wherein a rotation axis of the dustpan is positioned on a rotation axis of the agitator.

2. The mobile cleaner of claim 1, wherein the dustpan is disposed at an area of 40% to 70% around an outer circumference of the agitator.

3. The mobile cleaner of claim 1, wherein the dustpan moves within an arc having a center angle of 180 degrees to 220 degrees around the outer circumference of the agitator, and wherein the dustpan has a smaller length than the arc.

4. The mobile cleaner of claim 1, further comprising:

a spin mop rotatably coupled to the body, wherein a mop portion is attached to a lower surface of the spin mop.

5. The mobile cleaner of claim 1, wherein the agitator and the dustpan are installed in the dust housing and the storage space is formed in the dust housing.

6. A mobile cleaner, comprising:

a dust housing having a collection opening facing a surface that the mobile cleaner moves on;

an agitator rotatably disposed within the dust housing and exposed to the surface through the collection opening, the agitator configured to be in contact with the surface and configured to rotate and move foreign material on the surface into the dust housing; and a dustpan installed on the dust housing or the agitator, the dustpan being configured to direct the foreign material moved by the agitator into the dust housing, wherein the dustpan extends around a portion of an outer circumferential surface of the agitator and is configured to rotate independent of the agitator, wherein the dustpan is coupled to the dust housing, and wherein the dustpan covers the portion of the outer circumferential surface of the agitator and portions of opposite side surfaces of the agitator.

7. The mobile cleaner of claim 6, wherein, with reference to a direction of motion of the mobile cleaner, the agitator rotates from a front side to a rear side, and wherein the dustpan is disposed at a rear side of the agitator.

8. The mobile cleaner of claim 6, wherein a rotation axis of the dustpan is positioned on a rotation axis of the agitator.

9. The mobile cleaner of claim 6, wherein the dustpan further comprises:

a guide pan housing extending around a portion of the outer circumferential surface of the agitator; and a side pan housing disposed on one side of the guide pan housing and extending around a side portion of the agitator.

10. The mobile cleaner of claim 9, wherein the guide pan housing comprises:

a curved portion extending around the outer circumferential surface of the agitator; and a dust guard coupled to a lower end of the curved portion, the dust guard being in contact with the surface, wherein the dust guard protrudes to a lower side of the collection opening, and wherein the dust guard is formed of an elastic material.

11. The mobile cleaner of claim 10, wherein a center of curvature of the curved portion is disposed inside the agitator.

12. The mobile cleaner of claim 9, further comprising:

a through-hole extending through the side pan housing; and a pan guide positioned in the through-hole, wherein a side portion of the agitator is rotatably supported by the housing assembly via the through-hole, and wherein the side pan housing is rotatably supported by the pan guide.

13. A mobile cleaner, comprising:

a dust housing having a collection opening facing a surface that the mobile cleaner moves on;

an agitator rotatably disposed within the dust housing and exposed to the surface through the collection opening, the agitator configured to be in contact with the surface and configured to rotate and move foreign material on the surface into the dust housing; and a dustpan installed on the dust housing or the agitator, the dustpan being configured to direct the foreign material moved by the agitator into the dust housing, wherein the dustpan extends around a portion of an outer circumferential surface of the agitator and is configured to rotate independent of the agitator, wherein the dust housing comprises:

a housing assembly having a collection space and a storage space positioned within the housing assembly, the collection opening being disposed at a bottom surface of the housing assembly and fluidly coupled with a lower side of the collection space;

a partition wall partitioning the collection space and the storage space; and a storage opening disposed at any one of the housing assembly or the partition wall, the storage opening being configured to direct the foreign material in the collection space into the storage space, and wherein the agitator and the dustpan are disposed in the collection space.

14. The mobile cleaner of claim 13, wherein a rotation axis of the agitator extends in a left-right direction, and wherein the dustpan is disposed at an opposite side of the partition wall with respect to the rotation axis of the agitator.

15. The mobile cleaner of claim 13, further comprising:

a pan elastic member having a first end fixed to a first pan fixing portion of the dustpan and a second end fixed to a second pan fixing portion of the housing assembly.

16. The mobile cleaner of claim 15, wherein the first pan fixing portion is disposed higher than the second pan fixing portion.

17. The mobile cleaner of claim 15, wherein the rotation axis of the agitator extends in a left-right direction, and wherein the first pan fixing portion and the second pan fixing portion are disposed at an opposite side of the partition wall with respect to the rotation axis of the agitator.

18. The mobile cleaner of claim 15, further comprising:

a dustpan stopper disposed on the housing assembly, wherein the dustpan stopper is configured to limit rotation of the dustpan.

19. The mobile cleaner of claim 18, wherein the dustpan stopper is disposed on a lower side of the dustpan.

* * * * *